US007692603B1

(12) United States Patent
Cencich, Sr. et al.

(10) Patent No.: US 7,692,603 B1
(45) Date of Patent: Apr. 6, 2010

(54) SPIRAL ANTENNA

(75) Inventors: Thomas P. Cencich, Sr., Littleton, CO (US); Jeannette C. McDonnell, Littleton, CO (US); William N. Kefauver, Littleton, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 124 days.

(21) Appl. No.: 12/170,358

(22) Filed: Jul. 9, 2008

(51) Int. Cl.
*H01Q 1/36* (2006.01)

(52) U.S. Cl. ..... 343/895

(58) Field of Classification Search ..... 343/895
See application file for complete search history.

(56) References Cited

U.S. PATENT DOCUMENTS 4,630,064 A * 12/1986 Andrews et al. ..... 343/895
5,451,973 A * 9/1995 Walter et al. ..... 343/895
5,936,595 A * 8/1999 Wang ..... 343/895

* cited by examiner

*Primary Examiner*—Tan Ho
(74) *Attorney, Agent, or Firm*—McDermott Will & Emery LLP

(57) ABSTRACT

A spiral planar antenna includes more than two spiral arms. Each arm includes at least a portion that is coiled. The antenna may operate from approximately 50 MHz to upwards of several GHz within a payload space of only about 5.75 inches in diameter and less than one inch in height, with approximately 5 dBi or less of measured axial ratio. The broad frequency response in conjunction with a small space-profile improves space limitations and payload for deployable and non-deployable platforms while reducing opportunities for electromagnetic interference.

20 Claims, 20 Drawing Sheets

2 arms 4 arms

*4 arms*

*6 arms*

SPIRAL ANTENNA

STATEMENT REGARDING FEDERALLY SPONSORED RESEARCH OR DEVELOPMENT

Not applicable.

FIELD

The present invention generally relates to antennas and, in particular, relates to coiled spiral antennas.

BACKGROUND

Antennas operate to control energy wave propagation. They are critical components for various wireless transmission and reception systems, for example, telecommunication, aerospace, and/or data transmission systems in general.

Edwin Turner is credited with first generally investigating the spiral antenna in 1954 when he wound a long wire dipole into a spiral form and connected its terminals to a two-wire feed line. Results from his experiments have spurred investigation that continues even today.

Spiral antennas have been designed in various planar or conical shapes, the most common being the equiangular and Archimedean. Spirals operate in three simultaneous fashions: as fast-wave, as leaky-wave, and as traveling-wave antennas. Excited currents in the antenna conductors form a traveling wave that allows for broadband performance. The wave has a phase velocity in excess of the speed of light because of the mutual coupling between neighboring arms. The antenna leaks energy while propagating on the line to produce radiation.

SUMMARY

In an exemplary embodiment of the present invention, a radio frequency antenna device is provided for transmission/reception of energy waves across a broad spectrum of frequencies with improved performance in high and/or low frequency bands within a small profile. An exemplary embodiment of the instant invention includes multiple spiral arms, at least a portion of each being coiled. The antenna is generally planar with gaps between each arm, and is typically of a small geometry. In some instances the antenna is less than 1 inch in height and less than 12 inches in diameter. In some instances the antenna is less than 6 inches in diameter. In many of the exemplary embodiments described herein the antenna is approximately 5.75 inches in diameter and about 0.75 inches in height.

According to an embodiment, a planar antenna device comprises more than two conductive spiral arms, each comprising a coiled portion, a plurality of spiral gaps, a center dielectric portion, and an outlying dielectric portion. Each of the more than two conductive spiral arms is configured to receive a phase shifted input signal at a beginning point of the corresponding one of the more than two conductive spiral arms in the center dielectric portion. Each of the more than two conductive spiral arms spirals from the beginning point of the corresponding one of the more than two conductive spiral arms in the center dielectric portion to an end point in the outlying dielectric portion in a radially increasing manner. Each of the plurality of spiral gaps spirals from a beginning point of the corresponding one of the plurality of spiral gaps toward an outer edge of the outlying dielectric portion in a radial manner.

According to an embodiment, a planar antenna device comprises a plurality of conductive spiral arms, each comprising a coiled portion, a plurality of spiral gaps, a center dielectric portion, and an outlying dielectric portion. The center dielectric portion comprises a first planar thickness, the outlying dielectric portion comprises a second planar thickness, and the first planar thickness is less than the second planar thickness. Each of the plurality of conductive spiral arms is configured to receive a phase shifted input signal at a beginning point of the corresponding one of the plurality of conductive spiral arms in the center dielectric portion. Each of the plurality of conductive spiral arms spirals from the beginning point of the corresponding one of the plurality of conductive spiral arms in the center dielectric portion to an end point in the outlying dielectric portion in a radial manner. Each of the plurality of spiral gaps spirals from a beginning point of the corresponding one of the plurality of spiral gaps toward an outer edge of the outlying dielectric portion in a radial manner.

According to an embodiment, a planar antenna device comprises a plurality of conductive spiral arms, a plurality of spiral gaps, a center dielectric portion, an outlying dielectric portion and a wall. Each of the plurality of conductive spiral arms is configured to receive a phase shifted input signal at a beginning point of the corresponding one of the plurality of conductive spiral arms in the center dielectric portion. Each of the plurality of spiral gaps spirals from a beginning point of the corresponding one of the plurality of spiral gaps toward an edge of the outlying dielectric portion in a radial manner. Each of the plurality of conductive spiral arms spirals at least in a first direction from the beginning point of the corresponding one of the plurality of conductive spiral arms in the center dielectric portion toward the outlying dielectric portion in a radially increasing manner. After spiraling to the outlying dielectric portion, each of the plurality of conductive spiral arms travels in the wall at least in a second direction in a coiled manner from a first point to a second point forming a coil arm between its first point and its second point. In this embodiment, the second direction is different from the first direction.

Additional features and advantages of the invention will be set forth in the description below, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF DRAWINGS

The invention both to its organization and manner of operation, may be further understood by reference to the drawings that include FIGS. 1 through 27B, taken in connection with the following descriptions.

DETAILED DESCRIPTION

The following description of illustrative non-limiting exemplary embodiments of the invention discloses specific configurations and components. However, the exemplary embodiments are merely examples of the present invention, and thus, the specific features described below are merely used to describe such exemplary embodiments to provide an overall understanding of the present invention. One skilled in the art readily recognizes that the present invention is not limited to the specific exemplary embodiments described below. Furthermore, certain descriptions of various configurations and components of the present invention that are known to one skilled in the art are omitted for the sake of clarity and brevity. Further, while the term "exemplary embodiment" may be used to describe certain aspects of the invention, the term "exemplary embodiment" should not be construed to mean that those aspects discussed apply merely to that embodiment, but that all aspects or some aspects of the disclosed invention may apply to all exemplary embodiments, or some exemplary embodiments.

Figure 1A:
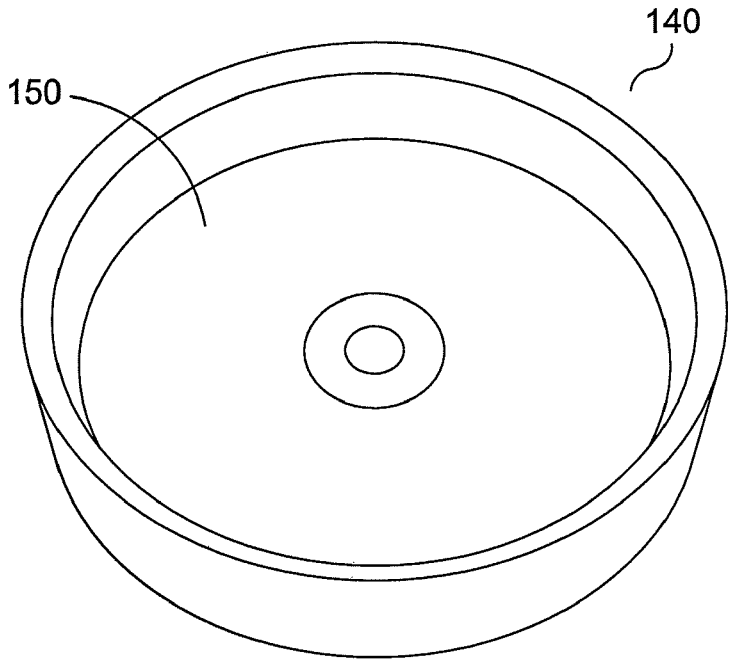
FIG. 1A illustrates an aspect of an exemplary embodiment of the present invention including a housing.
Figure 1B:
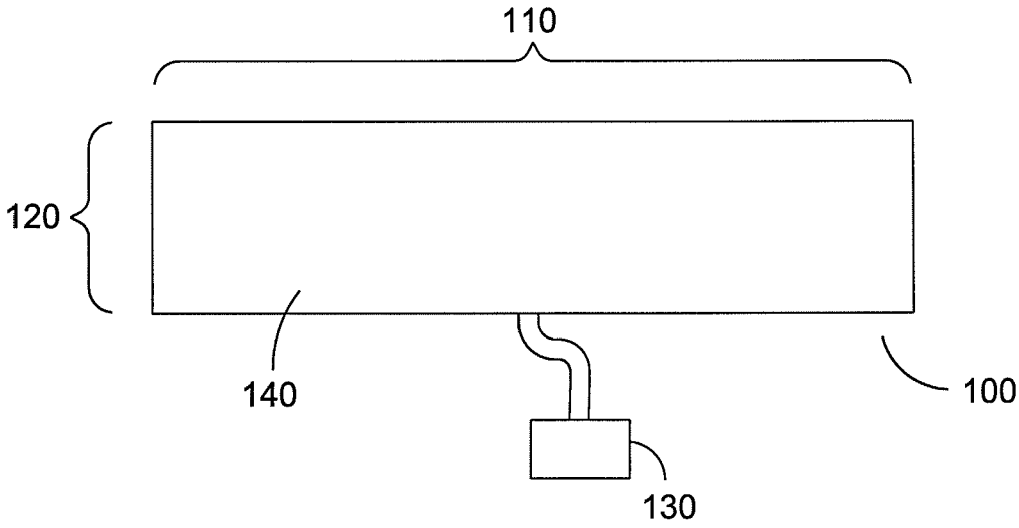
FIG. 1B illustrates a side view of an exemplary embodiment of the invention showing approximate dimensions.

FIGS. 1A and 1B illustrate overall dimensions of an exemplary embodiment of a planar antenna device 100. The planar antenna device 100 may be a coiled spiral antenna including a diameter 110 of approximately 5.75 inches and a depth 120 of one inch or less. In certain exemplary embodiments the depth 120 may be 0.75 inches or less. The planar antenna device 100 is provided with an input connector 130 which may be an SMA, a TNC, or N connector, another input connector type, or other type of transmission line interface. An antenna substrate (not shown) rests within housing 140. Housing 140 may resemble a pie tin in shape and is typically made of PVC but may be any suitable non-conductive material capable of providing structure for an antenna substrate.

The planar antenna device 100 typically radiates bi-directionally, with opposite polarization across two hemispheres. Many applications, however, require unidirectional radiation. In these instances a ferrite tile may be used such as shown by element 150 in FIG. 1A. The tile need not be located inside the cavity 140 and may be positioned externally, such as shown by ferrite tiles 510 in FIG. 5. Tile 150 may be any suitable radiation absorbing or reflecting material in addition to ferrite.

Figure 2:
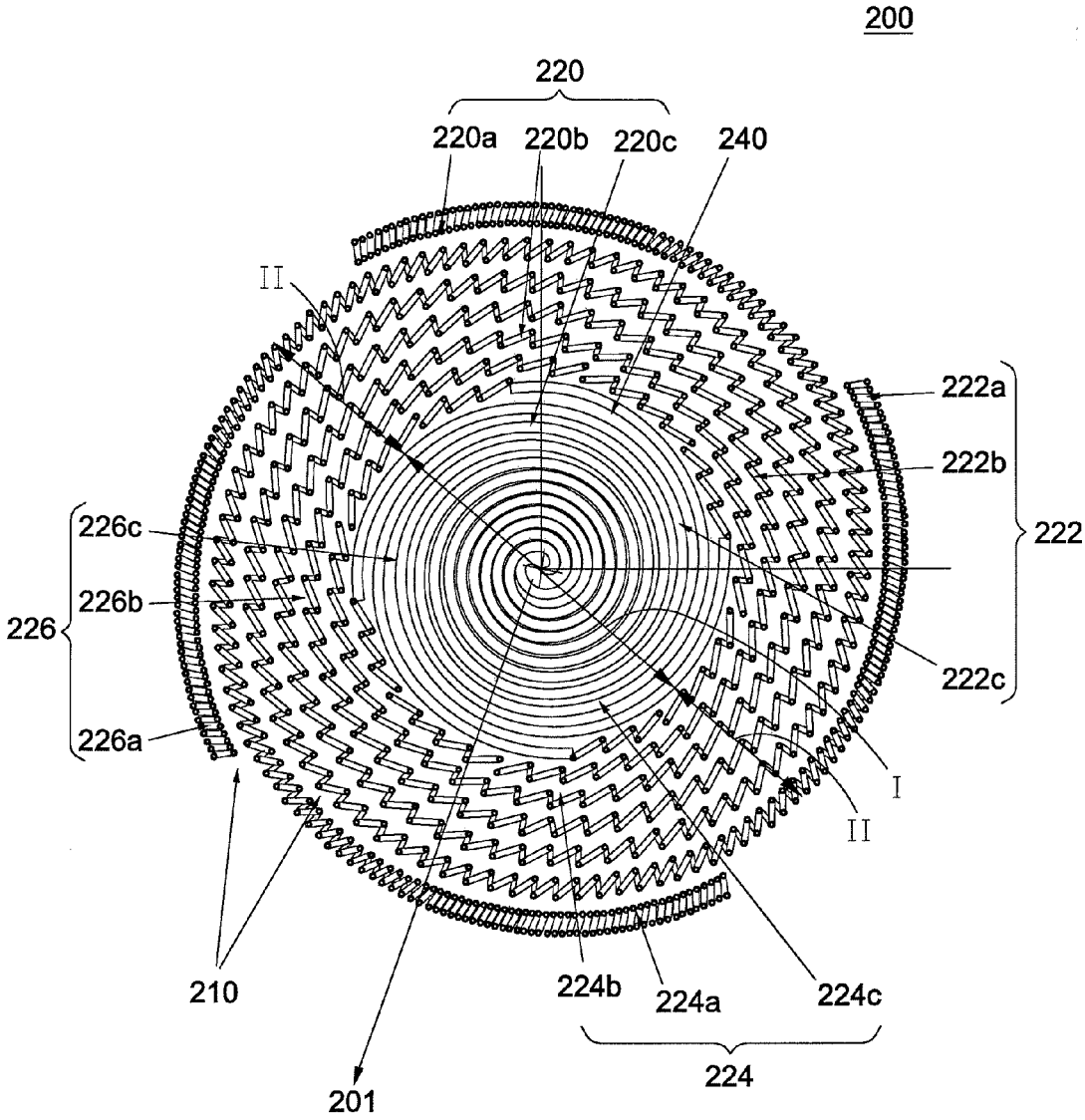
FIG. 2 illustrates a top plan view of an exemplary embodiment of the invention.
Figure 3:
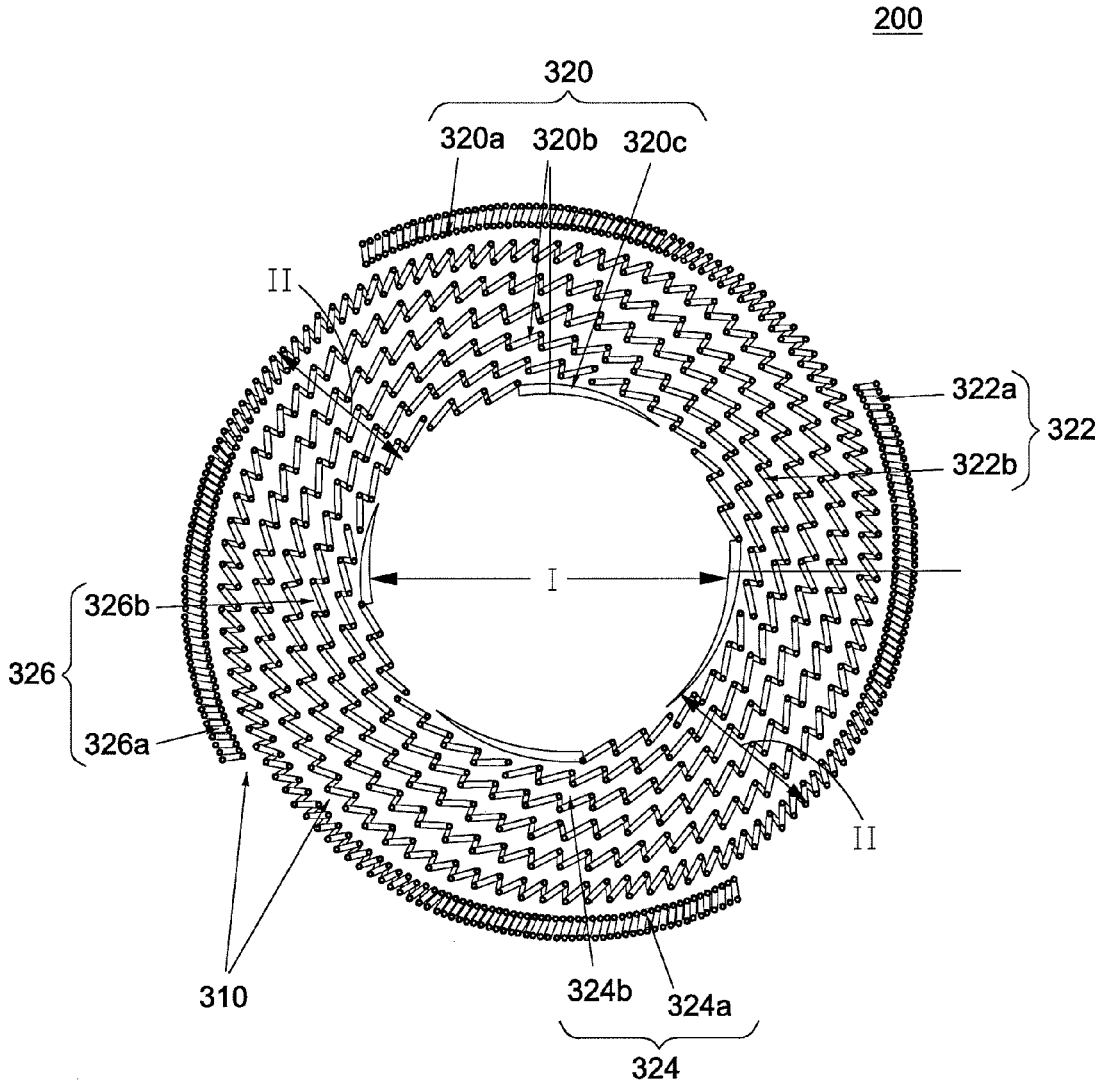
FIG. 3 illustrates a bottom plan view of an exemplary embodiment of the invention.

FIG. 2 illustrates an exemplary top plan view of a planar antenna device with four conductive antenna arms 220, 222, 224, and 226. FIG. 3 illustrates an exemplary bottom plan view of the planar antenna device of FIG. 2. The planar antenna device 200 may be a coiled spiral antenna having a center area I and an outer area II. In exemplary embodiments, center area I is comprised of a center dielectric portion 240, 340 and non-coiled center conductor portions 220*c*, 222*c*, 224*c*, and 226*c*. Non-coiled center conductor portions 220*c*, 222*c*, 224*c*, and 226*c* may be flat conductors that are disposed on top of the center dielectric portion 240 using a deposition or other process. In exemplary embodiments, outer area II is comprised of outlying dielectric portions 210, 310, tightly coiled end portions 220*a*, 222*a*, 224*a*, 226*a*, and loosely coiled middle sections 220*b*, 222*b*, 224*b*, and 226*b*.

Each of the four conductive arms 220, 222, 224, and 226 spirals in an outward, radial manner (in a radially increasing manner) in a first direction 201. First direction 201 travels from center area I to outer area II or from the center of the coiled spiral antenna to the outlying dielectric portion 210. While represented by a single arrow, first direction 201 represents a radial direction including 360 degrees that emanate from the center of the coiled spiral antenna on a plane created by center area I and outer area II.

Antenna arm 220 comprises tightly coiled end portion 220*a*, loosely coiled middle section 220*b*, and non-coiled center conductor portion 220*c*. Antenna arm 222 is comprised of tightly coiled antenna section 222*a*, loosely coiled antenna section 222*b*, and center non-coiled portion 222*c*, and the same goes for antenna arms 224 and 226. The planar antenna device 200 includes outlying dielectric portion 210 that may be comprised of any suitable dielectric. For instance, the outlying dielectric portion 210 may be made of a typical fluoropolymer such as Teflon (a product of DuPont Co.) and/or fiberglass, or may be made of Duroid (a product of Rogers Corporation), or any other suitable dielectric.

An exemplary embodiment of planar antenna device 200 may include thin center dielectric portion 240 made of, for example, Duroid, in center area I (i.e., in the area of antenna arm sections 220*c*, 222*c*, 224*c* and 226*c*). Thin dielectric portion 240 is approximately as thin as a few thousandths of an inch, and may be 5-60 mils in thinness, where 1 mil equates to 1 one-thousandth of an inch. The thinness of dielectric portion 240 improves the high frequency propagation of the antenna aims 220*c*, 222*c*, 224*c* and 226*c*. This is mainly because wavelengths at high frequencies are shorter than wavelengths at lower frequencies and the higher frequency wavelengths would see a theoretically highest-possible propagation if they were able to transmit through an environment with a dielectric 240 that approached the dielectric value of free space or air, or approximately the relative dielectric constant of 1.0.

Because dielectric 240 provides structure for the antenna arms, however, some solid, non-gaseous dielectric is needed. The thinness aspect of the instant invention provides a high-efficiency feed for high frequencies by making dielectric portion 240 as thin as approximately a few thousandths of an inch thick. In exemplary embodiments of the present invention the thickness of thin dielectric portion 240 is thinner than the thickness of the outlying dielectric portion 210. The thickness of dielectric portion 210 in exemplary embodiments provides structural support for both of the outlying dielectric portion 210, as well as for the center dielectric portion 240.

As shown in FIG. 2, thin dielectric portion 240 may be viewed as comprising physical gaps between adjoining non-coiled center conductor portions 220*c*, 222*c*, 224*c*, and 226*c*. The gaps are of a first width near the center of center area I, and progressively become wider and wider the farther they are located from the center of planar antenna device 200, including as they eventually become outlying dielectric portions 210, and as they progress towards an outer edge of outer area II.

Similarly, the non-coiled center conductor portions 220*c*, 222*c*, 224*c*, and 226*c* begin at a first width near the center of center area I, and they progressively become wider and wider the farther they are located from the center of planar antenna device 200, including as they eventually become loosely coiled middle sections 220*b*, 222*b*, 224*b*, and 226*b*, and then become tightly coiled end portions 220*a*, 222*a*, 224*a*, 226*a*, and eventually progress towards an outer edge of outer area II. Loosely coiled middle sections 220*b*, 222*b*, 224*b*, and 226*b* and tightly coiled end portions 220*a*, 222*a*, 224*a*, and 226*a* are comprised of multiple top segments, multiple bottom segments, and multiple vertical segments. Individual top segments are shown by the heads of arrows for elements 220*b*, 222*b*, 224*c*, and 226*c*. Individual bottom segments are shown by the heads of arrows for elements 320*b*, 322*b*, 324*b*, and 326*b*. Vertical segments are not shown because they exist within outer dielectric portions 210 and 310. Noticeably, individual top segments of the loosely coiled middle sections 220*b*, 222*b*, 224*b*, and 226*b* are spaced farther apart than are individual top segments located in tightly coiled end portions 220*a*, 222*a*, 224*a*, and 226*a*.

In exemplary embodiments of the present invention the width of certain gap areas are configured to be a certain width in relation to the width of certain antenna arm portions. In certain exemplary embodiments the width of an individual gap (e.g., element 2007 shown in FIG. 20) at the center of center area I is configured to be less than the width (e.g., element 2008 shown in FIG. 20) of the individual ones of non-coiled center conductor portions 220*c*, 222*c*, 224*c*, and/or 226*c*. This configuration may be referred to as being "non-complimentary."

In certain exemplary embodiments the width (e.g., element 809 shown in FIG. 8) of an individual one of tightly coiled end portions 220*a*, 222*a*, 224*a*, and/or 226*a* in outer area II is configured to be approximately equal (that is, substantially equal at least in comparison to the non-complimentary aspects discussed previously) to the width of a gap (e.g., element 806 shown in FIG. 8) between adjoining tightly coiled end portions 220*a*, 222*a*, 224*a*, and/or 226*a*. This configuration may be referred to as being "complimentary."

By varying non-complimentary widths in center area I, various exemplary embodiments of the instant invention are able to make an impedance match (or an approximate impedance match) between an input signal and the antenna itself. That is, input impedance may be set by altering the difference in width between an individual gap at the very center of center area I and the width of individual ones of non-coiled center conductor portions 220*c*, 222*c*, 224*c*, and/or 226*c*.

Furthermore, an aspect of an exemplary embodiment of the present invention where the width of the gaps in outer area II approaches approximately the same widths of individual ones of tightly coiled end portions 220*a*, 222*a*, 224*a*, and/or 226*a* enables the planar antenna device 200 to be efficiently fed. The impedance matching at an input to the antenna as reflected by a non-complimentary configuration of the dielectric in the center area (for example, area I in FIG. 2) in conjunction with the complimentary spiral in the outer diameter area (for example, area II in FIG. 2) enables various exemplary embodiments of the invention to be efficiently fed. Efficient feeding of the antenna arms is one of the aspects of the present invention enabling enhanced propagation, for instance, the enhanced propagation as shown in and as discussed in relation to FIGS. 11-19.

FIG. 3 illustrates four antenna arm portions 320, 322, 324 and 326. Each of these four arms includes tightly coiled spiral sections 320*a*, 322*a*, 324*a*, 326*a*, and loosely coiled spiral elements 320*b*, 322*b*, 324*b*, 326*b*. As shown by portion 340 the non-coiled section of the antenna arms 220*c*, 222*c*, 224*c*, 226*c* of FIG. 2 are not visible in FIG. 3. This is because sections 220*c*, 222*c*, 224*c*, and 226*c* are on the opposite side of the substrate and their view is thus obscured by thin dielectric 340. The dielectric 340 may be thin in the center portion of the antenna portion to allow for enhanced high frequency performance as described previously.

In either FIG. 2 or 3, the conducting material may be copper, gold, platinum, copper covered gold or platinum, or any suitable transmitting conductive material. In either FIG. 2 or 3, the process to manufacture an antenna would include the use of a substrate. The substrate may be of a dielectric material, and the antenna arms (e.g., tightly wound coils 220*a* or 320*a*, coils 220*b* or 320*b*, and/or the high frequency conductors 220*c*, 222*c*, etc.) may be produced using photolithography and deposition/etch processes.

When creating aspects of the present invention including the coiled sections of the spiral antenna arms, two substrates may be used: a first substrate that includes the top portion of the coils, and a second substrate that includes the bottom portion of the coils. Stated differently, a substrate could be used to create the antenna portions shown in FIG. 2, for instance, and a separate substrate could be used to create the antenna portions shown in FIG. 3. These two substrates may then be placed together to create one substrate with via holes acting as potential conduits between each of the top and bottom sections of the coils. (Individual coils are shown in greater detail in FIG. 8.)

Upon completion of the deposition process and/or adhesion of the first and second substrates to each other, an electrolysis (or other) process may be used to fill each of the via holes. In addition to electrolysis, other known methods such as a deposition process may be used to place conductive material into the via holes. Deposition may also be used to fill in photo-etched sections of the substrate. In different aspects of the invention, the coiled spiral antenna elements may be made using a photolithography and/or other processes on both sides of the same substrate.

Once an electrolysis or other process is used to fill the via holes with conductive material the antenna arms 220 and 320 are electrically the same conductive arm from a signal input point at the center area I of the spiral to the end of the antenna arm at a very outer portion of the outer area II of the coiled spiral antenna. The same may apply for antenna arms 222 and 322, 224 and 324, and 226 and 326.

Figure 4:
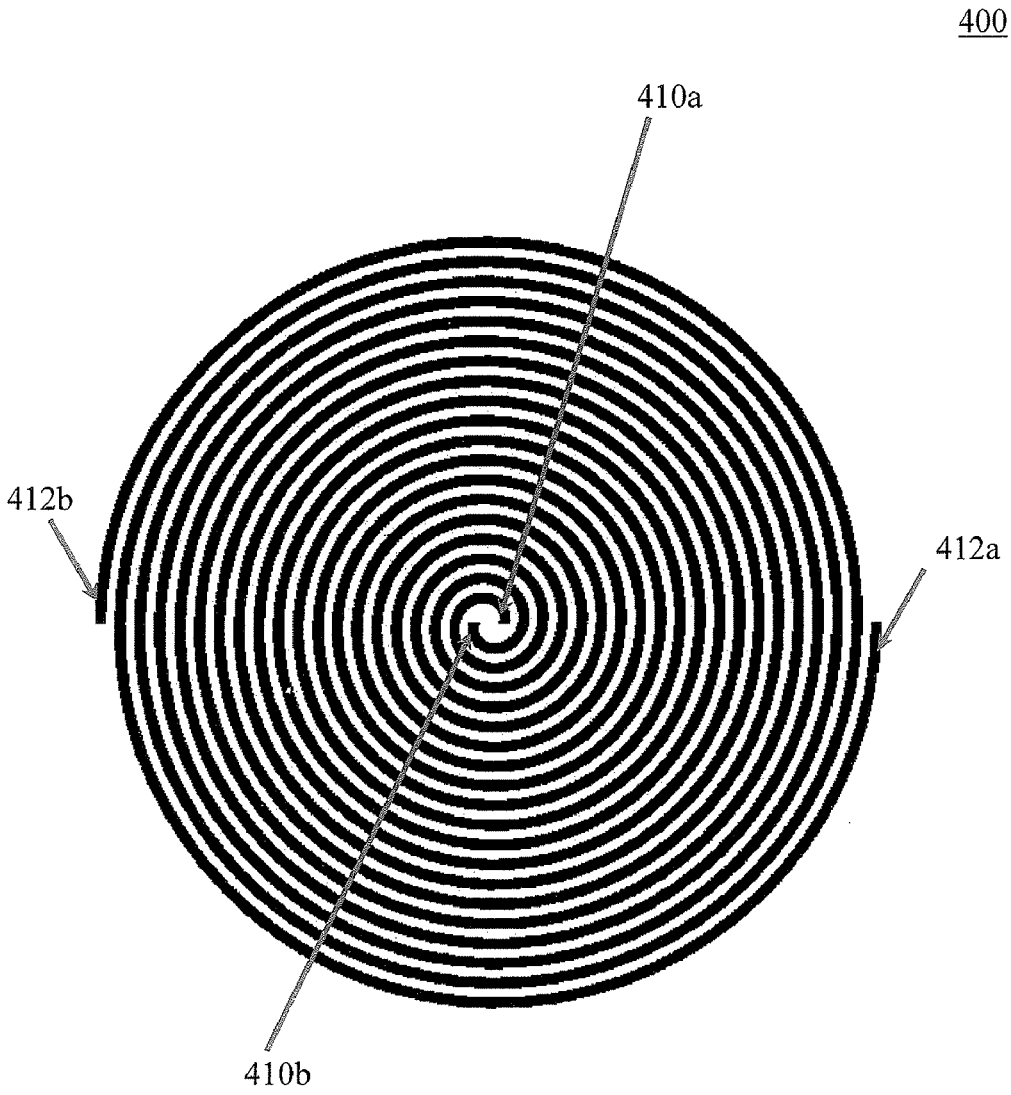
FIG. 4 illustrates an exemplary non-coiled spiral antenna.

FIG. 4 illustrates an exemplary two arm antenna that is completely non-coiled from input feeds 410*a* and 410*b* to the end of the antenna arms 412*a* and 412*b*. The non-coiled spiral antenna 400 has a diameter of about six inches. A measured axial ratio for this antenna would be similar to the measured axial ratio shown in FIG. 25 for a two-armed coiled spiral antenna. For the exemplary two-arm non-coiled antenna, it can be expected that below about 700 MHz the measured axial ratio will start to oscillate above 5 dB, and below 500 MHz, the axial ratio will remain above 5 dB. The cross-polarization expressed by the measured axial ratio above 5 dB indicates that it is approaching or even exceeding levels of co-polarization, a state that is undesirable. This undesirable state stems from reflected currents radiating at high levels which have an extreme negative effect on the polarization purity.

Figure 5:
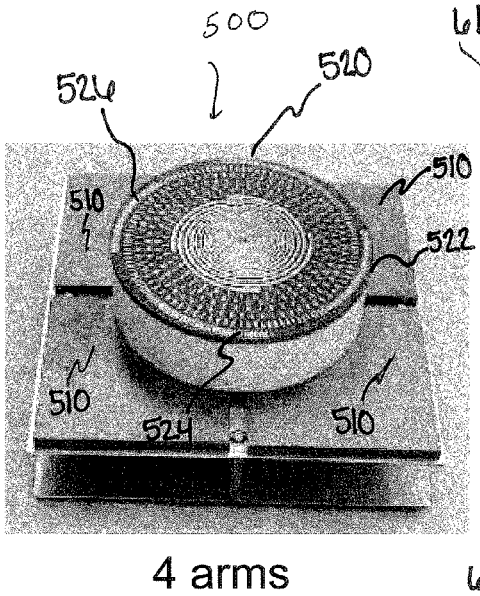
FIG. 5 illustrates a top down side view of a spiral antenna with four spiral arms according to an exemplary embodiment of the present invention.

FIG. 5 illustrates a top down side view of a planar antenna device in an exemplary embodiment of the invention including four antenna arms 520, 522, 524 and 526. The number of antenna arms may be as many as will fit within the actual space with which they could be imprinted on an exemplary substrate. For instance while various aspects and various exemplary embodiments of the invention include descriptions of a plurality of arms, the total number may be as many as will fit within the physical limitations of mechanical processes and/or chemical processes used to create the arms on the substrate. A planar antenna device 500 may be a coiled spiral antenna which sits on four ferrite tiles 510 to allow for unidirectional radiation in a direction away from the tiles 510.

Figure 6:
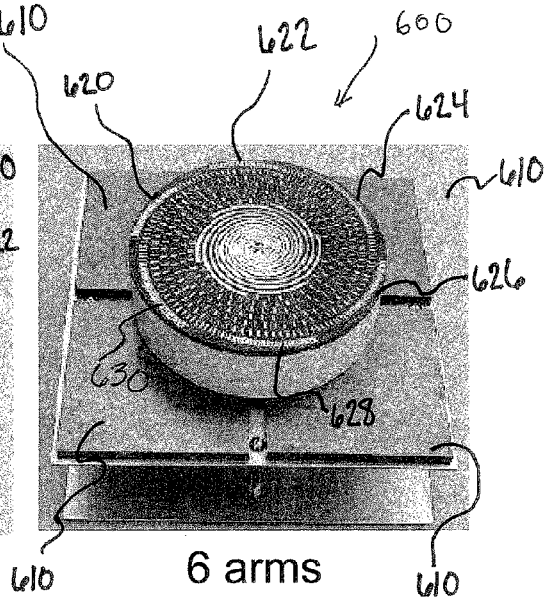
FIG. 6 illustrates a top down side view of a spiral antenna with six antenna arms according to an exemplary embodiment of the present invention.

FIG. 6 illustrates a top down side view of a planar antenna device in an exemplary embodiment of the invention including six antenna arms 620, 622, 624, 626, 628 and 630. A planar antenna device 600 may be a coiled spiral antenna which sits on four ferrite tiles 610. The radiation absorbing function of ferrite tiles 610 may be completed by use of a circular absorber within the antenna cavity, as shown in FIG. 1A.

Figure 7B:
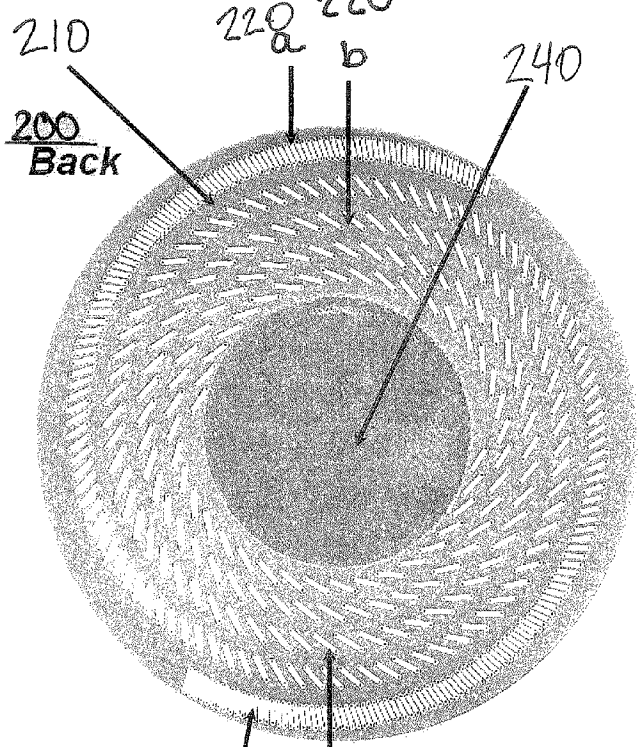
FIG. 7B illustrates a bottom plan view of the antenna shown in FIG. 7A according to an exemplary embodiment of the present invention.
Figure 7A:
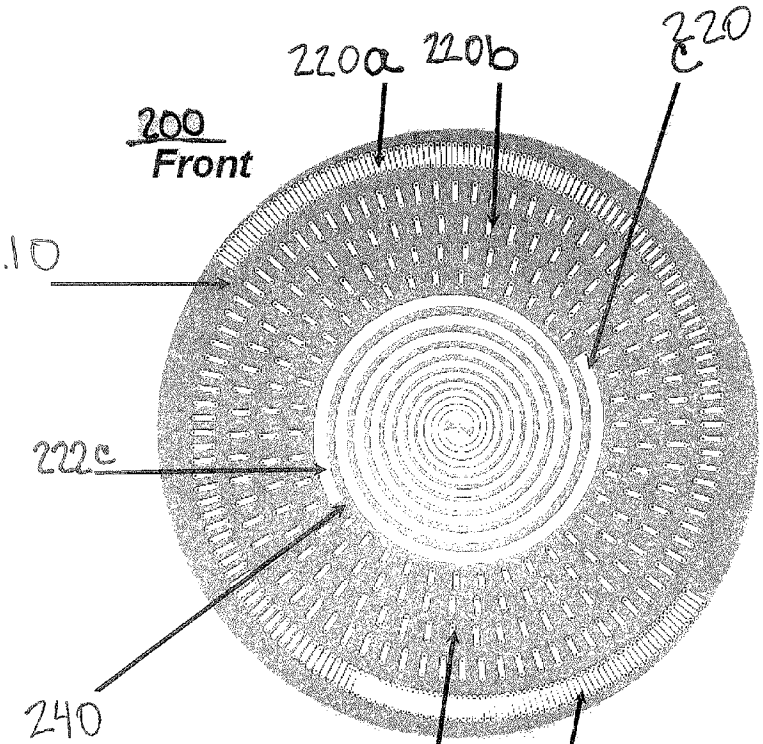
FIG. 7A illustrates a top plan view of a two-arm spiral antenna according to an exemplary embodiment of the present invention.
Figure 20:
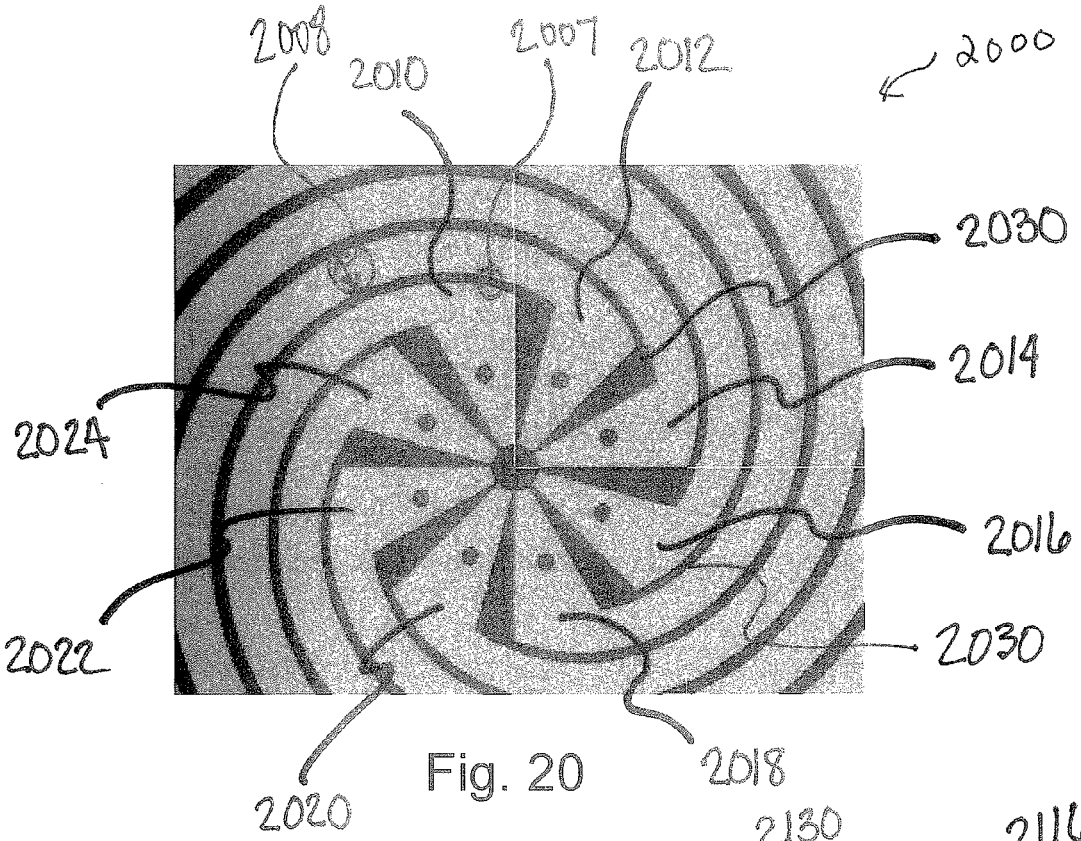
FIG. 20 is a top plan view of an antenna according to an exemplary embodiment of the present invention.

FIGS. 7A (top plan view) and 7B (bottom plan view) illustrate an exemplary embodiment of the present invention including a two-armed planar antenna device 200. The antenna device 200 includes arms 220 and 222. Each arm includes a tightly coiled portion 220*a* and 222*a*, a loosely coiled portion 220*b* and 222*b*, and a non-coiled section 220*c* and 222*c*, respectively. The arms are supported by a dielectric substrate 210, 240. Substrate portion 240 is a thin dielectric on the order of 5-60 mils thick to achieve a highly efficient high frequency feed as discussed herein in relation to FIG. 2 (that discussion will not be reiterated for the sake of brevity). Outlying dielectric portion 210 is of a greater thickness than inner dielectric portion 240 so that the plane of the planar antenna device 200 has superior overall strength/durability. Aspects of the invention include the possibility of making the width of the dielectric portion 240 less than the width of the antenna arms 220*c*, 222*c* so that a non-complimentary effect is achieved that allows for an impedance match to be made between an input signal and the antenna (for instance, as shown in FIG. 20 by elements 2007 and 2008, respectively, as the width of an individual gap and the width of an individual antenna arm). Additionally, a complimentary (i.e., similar) width between gaps and individual ones of arms 220*a*, 222*a* allows for enhanced propagation of radiation waves.

The antenna portions shown in FIGS. 7A (top plan view) and 7B (bottom plan view) may be made from one substrate or made from two or more different substrates. If they are made from two different substrates, they are attached to one another as described in relation to FIGS. 2 and 3, thereby allowing creation of the coiled spirals.

Figure 8:
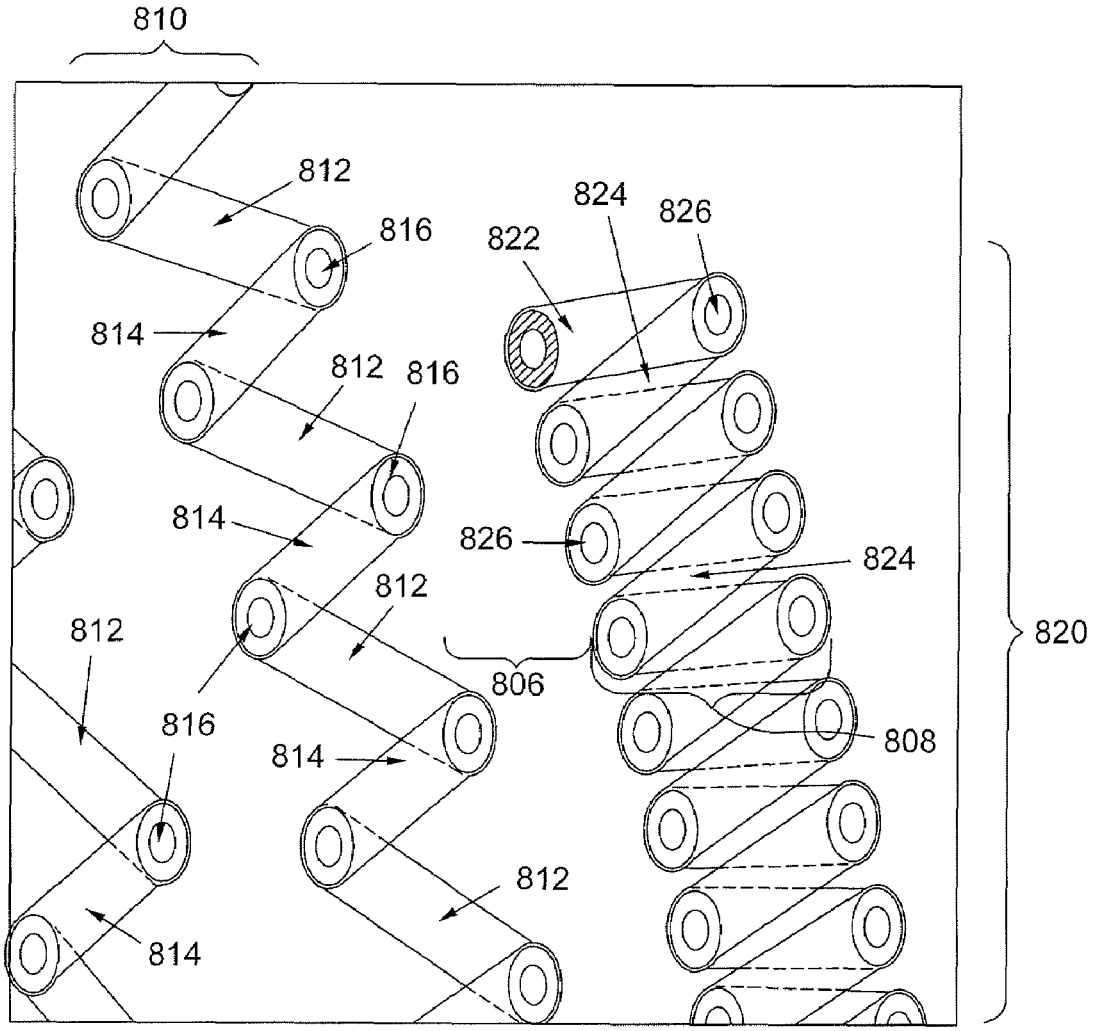
FIG. 8 illustrates an exemplary embodiment of the invention showing formation of coiled spirals.

FIG. 8 is a top-down view of both loosely wound coils 810 and tightly wound coils 820 as aspects of various exemplary embodiments of the instant invention. The view is from the perspective of looking directly down at the plane of a planar antenna device, for instance, a coil spiral antenna shown in FIGS. 2, 3, 7A and/or 7B. The coils 810 are farther apart from each other than coils 820. Coils 810 are thus described as loosely wound while coils 820 are described as tightly wound. The coil portions 812 (top segments) are all located on the top side of the substrate in comparison to coil portions 814 (bottom segments) that are located on an opposite side. The opposing sections of coil 812 and 814 are connected by via holes 816 (vertical segments). During the manufacturing process coil portions 812 and 814 are filled with a conductive material and then via holes 816 undergo a further deposition, electrolysis, or other process to fill in the holes with a conductive material. In this fashion a three-dimensional coil is formed. The same or similar process is used to create the tightly wound coils 820. Conductive coil portions 822 and 824 are on opposite sides of the substrate and via holes 826 are filled in to allow for electrical conductivity throughout the coil.

Figure 9:
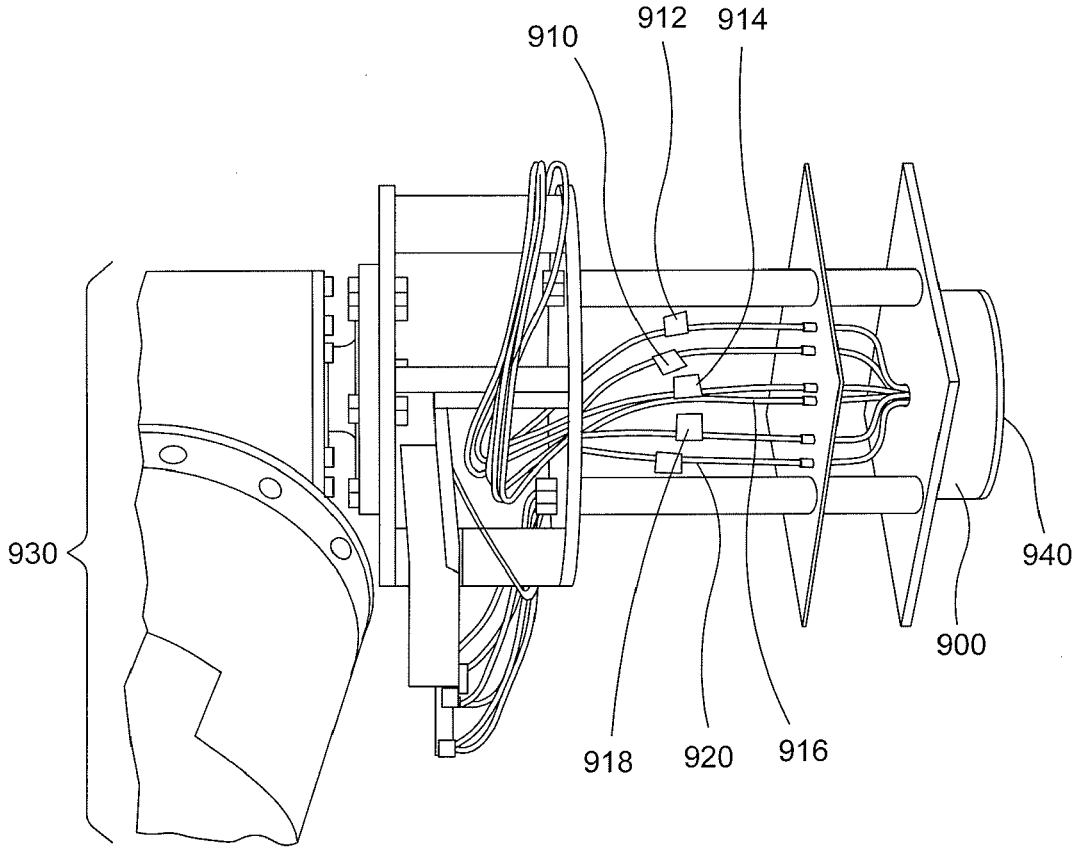
FIG. 9 is an illustration of an exemplary embodiment of the present invention being tested in a tapered chamber.

FIG. 9 illustrates testing of an exemplary planar antenna device in an anechoic chamber according to one aspect of an exemplary embodiment of the invention. A planar antenna cap 940 is the top piece of coiled spiral antenna 900, which has six antennas arms. Coiled spiral antenna 900 sits atop the chamber test equipment 930. As shown by cables 910, 912, 914, 916, 918 and 920 the antenna 900 is provided with six inputs. Each of the inputs for feed elements 910, 912, 914, 916, 918 and 920 is of equal amplitude but is phase shifted in equal amounts based on the number of antenna arms and/or inputs. Even though feed elements 910, 912, 914, 916, 918 and 920 are shown as possessing six inputs, it would be clear to one of skill in the art that a beam former could be used to vary the amplitude and phase (with N inputs) to thereby allow a six arm antenna to have a single input instead of multiple inputs. In an exemplary embodiment, a six arm antenna can form useful higher order modes, and in those instances a beamformer may be provided with several inputs.

Figure 10:
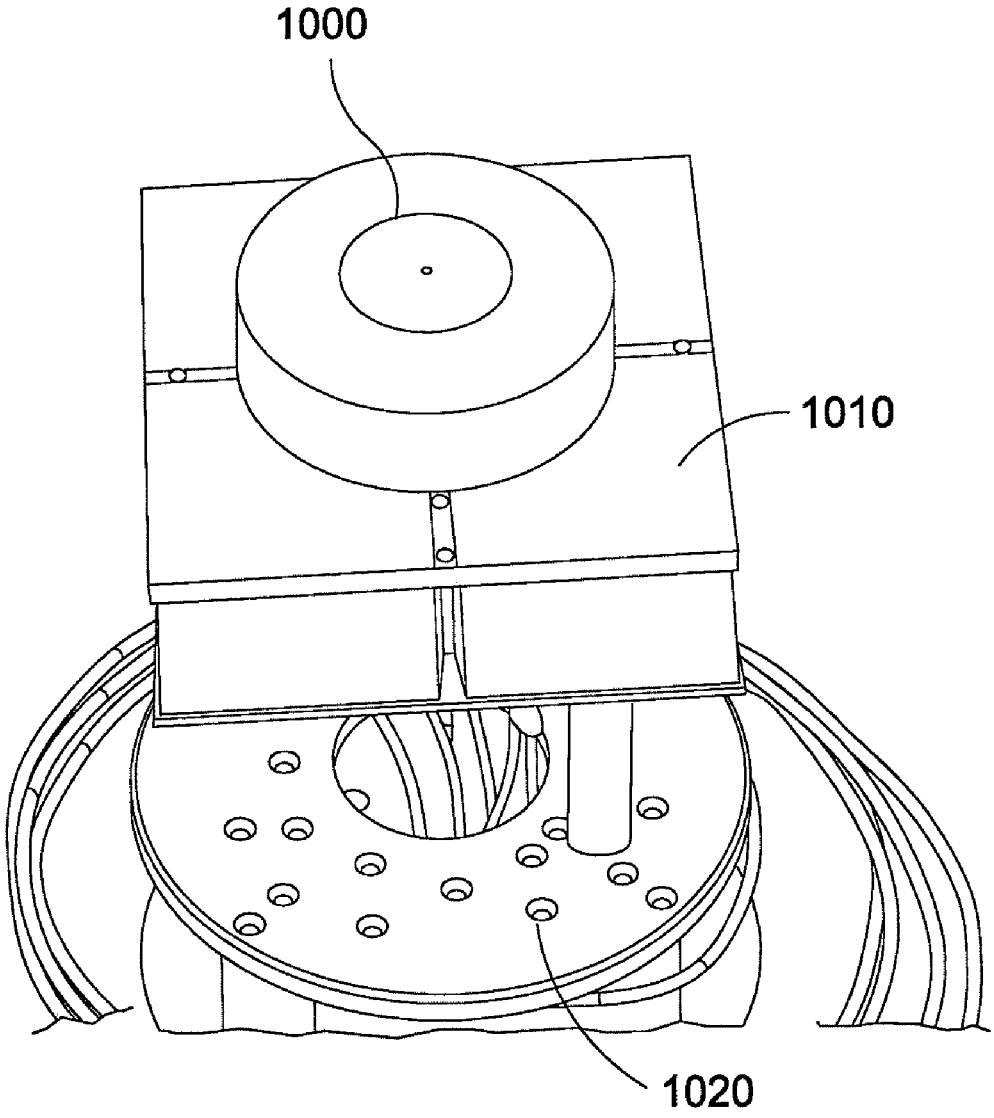
FIG. 10 shows an exemplary embodiment of the present invention being tested in a tapered chamber.

FIG. 10 illustrates an exemplary embodiment of a planar antenna device. The planar antenna device 1000 may be a coiled spiral antenna including ferrite tiles 1010. The tiles 1010 are useful for unidirectional transmission, as discussed previously. The planar antenna device 1000 sits atop the test equipment 1020. The tapered chamber test equipment 1020 (and 930 in FIG. 9) is (are) used to derive graphical representations of radiation patterns, for instance those patterns represented by FIGS. 11 through 19, and FIGS. 22 and 23. FIGS. 11 through 19, 22 and 23 were each derived using coiled spiral antennas that were approximately 5.75 inches in diameter.

Figure 11:
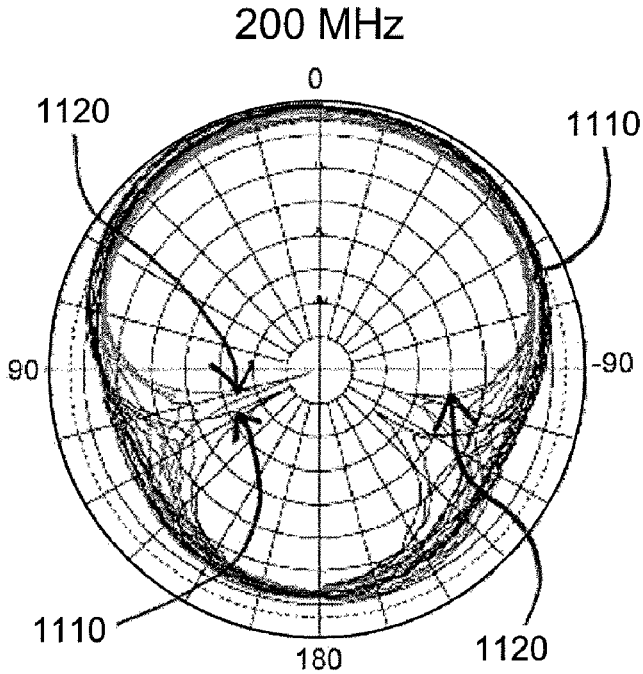
FIG. 11 is a graphical representation of a radiation pattern of a radio frequency wave propagated by an exemplary embodiment of the instant invention including a two-armed, coiled spiral antenna operating at 200 MHz.

In FIG. 11 a graphical representation of a radiation pattern propagated by an exemplary embodiment of the present invention including two coiled antenna arms at 200 Megahertz is shown. As show in the figure, the co-polarization 1110 appears to be slightly less than the cross-polarization 1120.

Cross-polarization is undesired because it reduces signal strength. Additionally, cross-polarization can decrease the signal to noise ratio of the intended transmission. For the previous reasons cross-polarization is undesired.

FIGS. 12 through 19, 22, and 23 reflect a cross-polarization comparison to co-polarization for exemplary embodiments of the present invention including planar antenna devices with more than 2 spiral antenna arms. As can be seen in these figures, the cross-polarization is much less than the co-polarization. Co-polarization is desired and as reflected in the noted figures, the patterns for the co-polarized signals are all circular and symmetrical. The patterns for co-polarized signals overlay fairly tightly as they approach their outer limits represented by the intended target 0 (zero) at the top of the graph. Because of this, the measured axial ratio for these antennas is less than 5 dB across a frequency range of 100 MHz to more than 6 GHz, as reflected by the graph of FIG. 27.

Figure 12:
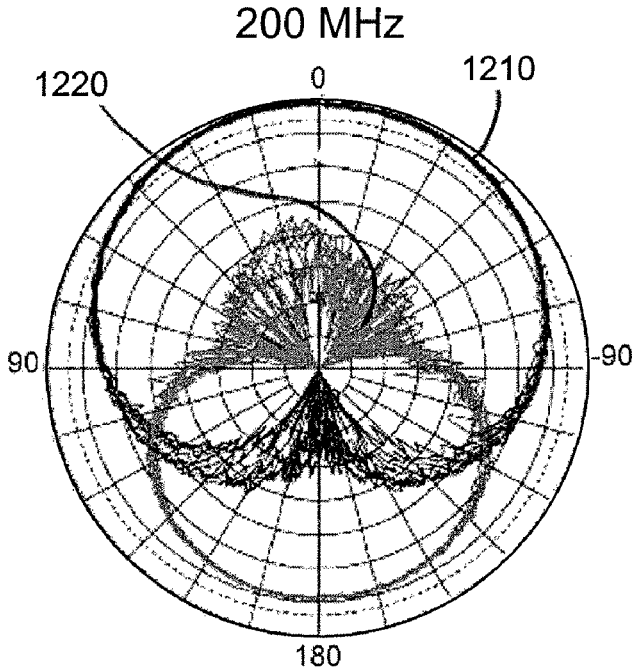
FIG. 12 is a graphical representation of a radiation pattern propagated by an exemplary embodiment of the instant invention with four antenna arms operating at 200 MHz.

FIG. 12 is a graphical representation of a radiation pattern propagated by a coiled spiral antenna including four antenna arms and operating at 200 megahertz according to an aspect of an exemplary embodiment of the present invention. As shown in the figure, the cross-polarization 1220 is significantly less than co-polarization 1210.

Figure 13:
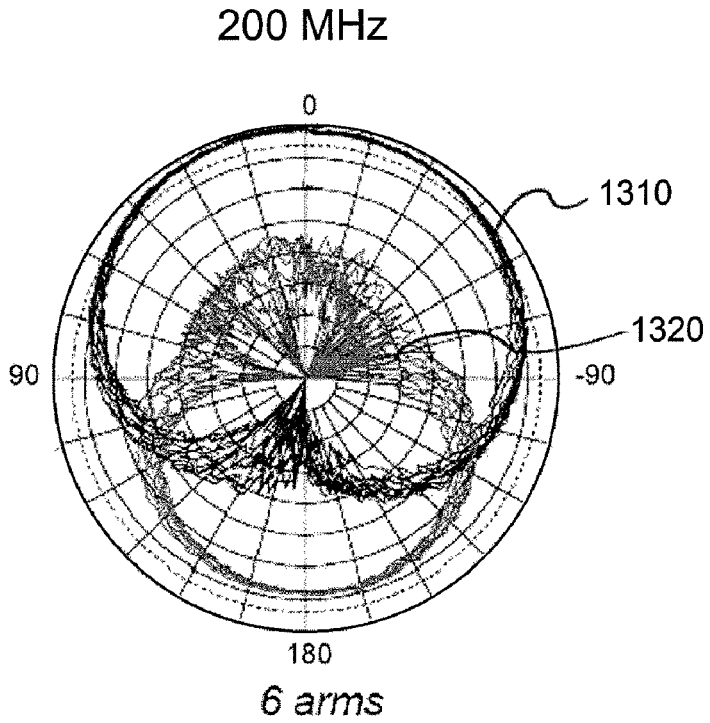
FIG. 13 is a graphical representation of a radiation pattern propagated by an exemplary embodiment of the present invention with six antenna arms operating at 200 MHz.

FIG. 13 is a graphical representation of a radiation pattern propagated by a coiled spiral antenna including six antenna arms and operating at 200 megahertz according to an aspect of an exemplary embodiment of the present invention. As shown in FIG. 13, the cross-polarization 1320 is significantly less that the co-polarization 1310. Again the cross-polarization 1320 being less than the co-polarization 1310 allows for a cleaner signal to be transmitted.

Figure 14:
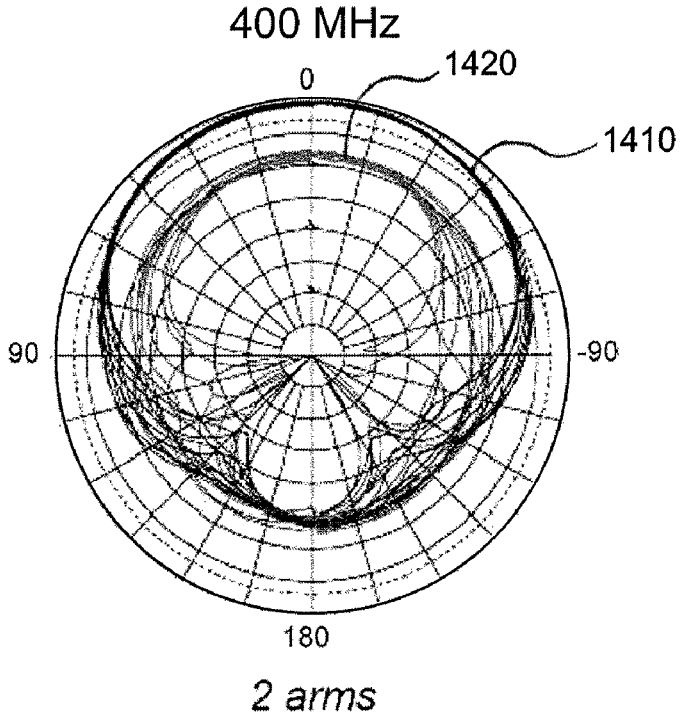
FIG. 14 is a graphical representation of a radiation pattern propagated by an exemplary embodiment of the present invention using two antenna arms operating at 400 MHz.

FIG. 14 is a graphical representation of a radiation pattern propagated by a coiled spiral antenna including two antenna arms and operating at 400 megahertz according to an aspect of an exemplary embodiment of the present invention. As shown in the graph, cross-polarization 1420 is improved in relation to FIG. 11. Further, the co-polarization 1410 is greater than the cross polarization 1420.

Figure 15:
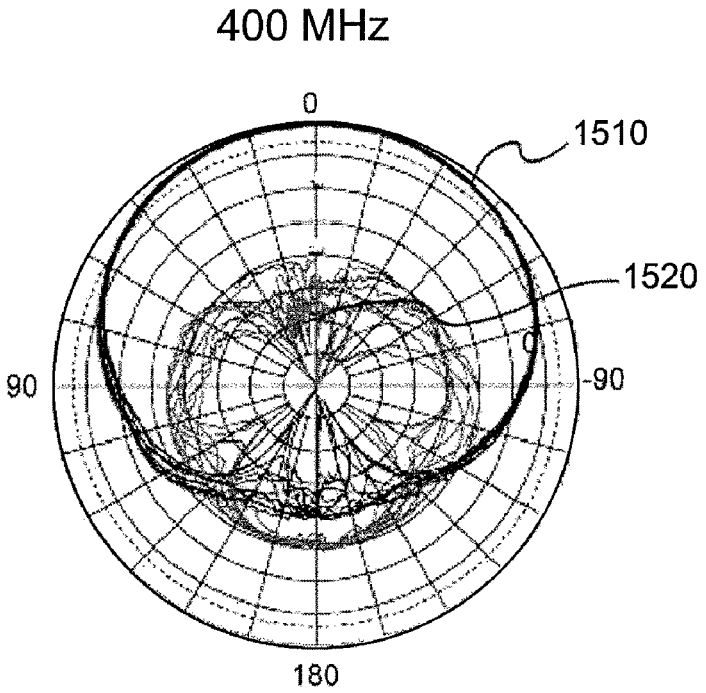
FIG. 15 is a graphical representation of a radiation pattern propagated by an exemplary embodiment of the present invention including four antenna arms operating at 400 MHz.

FIG. 15 is a graphical representation of a radiation pattern propagated by a coiled spiral antenna including four antenna arms and operating at 400 megahertz according to an aspect of an exemplary embodiment of the present invention. As shown in the figure, cross-polarization 1520 is significantly less than the co-polarization 1510.

Figure 16:
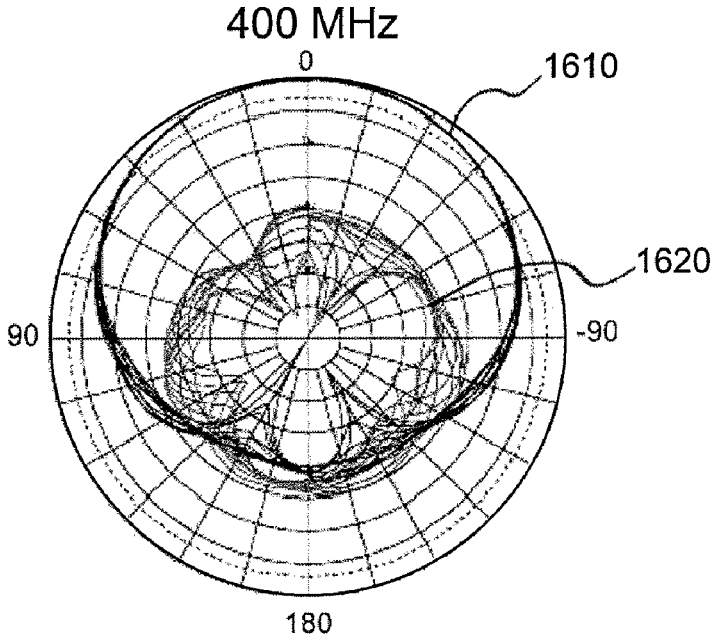
FIG. 16 is a graphical representation of a radiation pattern propagated by an exemplary embodiment of the present invention including six antenna arms operating at 400 MHz.

FIG. 16 illustrates a graphical representation of a radiation pattern propagated by a coiled spiral antenna including six coiled antenna arms and operating at 400 megahertz according to an aspect of an exemplary embodiment of the present invention. As shown in the figure the cross-polarization 1620 is significantly less than the co-polarization 1610.

Figure 17:
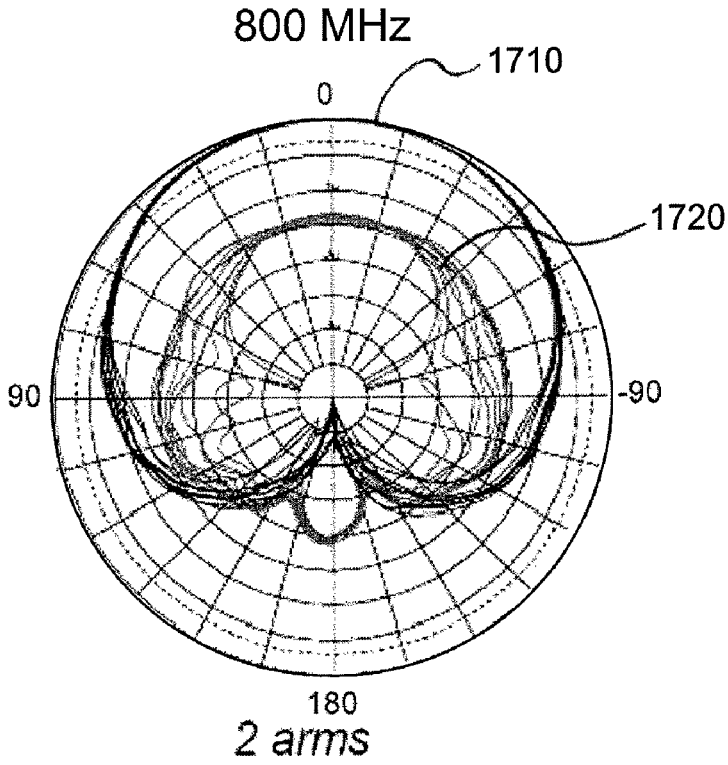
FIG. 17 is a graphical representation of a radiation pattern propagated by an exemplary embodiment of the instant invention including two antenna arms operating at 800 MHz.

FIG. 17 is a graphical representation of a radiation pattern propagated by a coiled spiral antenna including two coiled antenna arms and operating at 800 megahertz according to an aspect of an exemplary embodiment of the present invention. The cross-polarization 1720 is less than co-polarization 1710.

Figure 18:
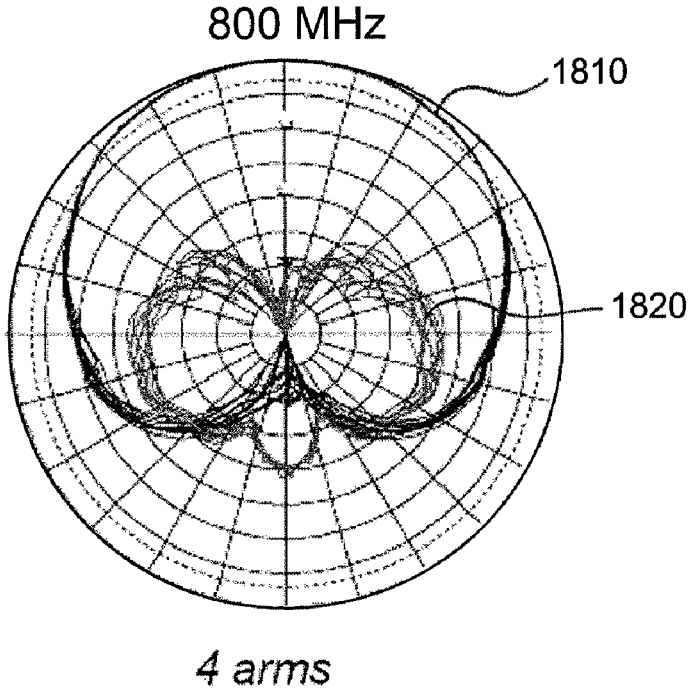
FIG. 18 is a graphical representation of a radiation pattern propagated by an exemplary embodiment of the present invention including four antenna aims operating at 800 MHz.

FIG. 18 is a graphical representation of a radiation pattern propagated by a coiled spiral antenna including four antenna arms and operating at 800 megahertz according to an aspect of an exemplary embodiment of the present invention. As show in the figure the cross-polarization 1820 is significantly less than the co-polarization 1810.

Figure 19:
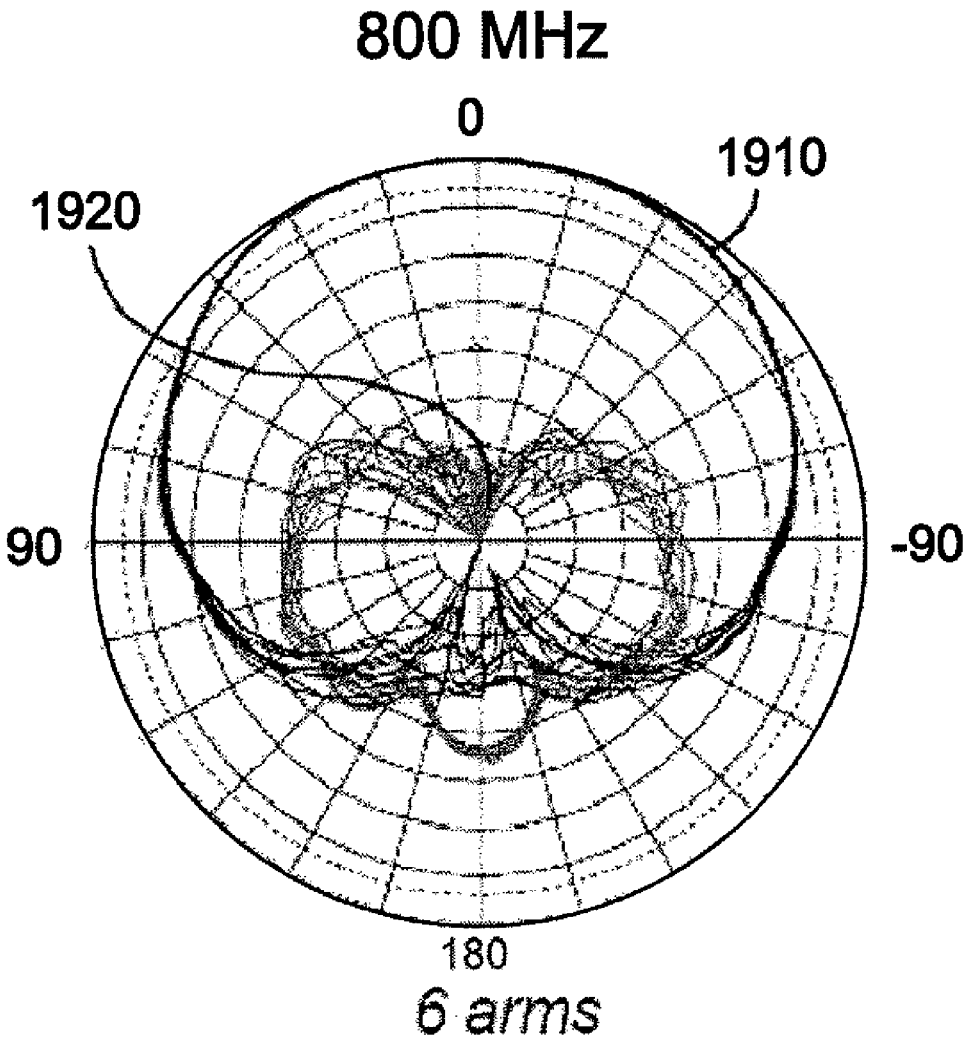
FIG. 19 is a graphical representation of a radiation pattern propagated by an exemplary embodiment of the present invention including six antenna arms operating at 800 MHz.

FIG. 19 is a graphical representation of a radiation pattern propagated by a coiled spiral antenna including six coiled antenna arms and operating at 800 megahertz according to an aspect of an exemplary embodiment of the present invention. As shown in the figure cross-polarization 1920 is significantly less than the co-polarization 1910.

In various aspects of the present invention the input signal is phase shifted for each individual antenna arm, such as antenna arms 220, 222, 224 and 226 as shown in FIG. 2. For instance, an input signal is phase shifted to provide a 0 degree phase shift to the input to antenna arm 220, the same signal is phase shifted 90 degrees as the input to antenna arm 222, the same signal is phase shifted 180 degrees for the input to antenna arm 224, and the same signal is phase shifted 270 degrees for antenna arm 226. For a six arm antenna the phase difference between each arm is sixty degrees, for an eight arm antenna is 45 degrees, and for a three arm antenna the phase difference between each arm is 120 degrees. Phase shifting may occur either externally to the antenna or within the antenna cavity. One of skill in the art would understand that a beam splitter, a coupler, and/or shifter may be used to split a signal to give it differently phased components.

Figure 21:
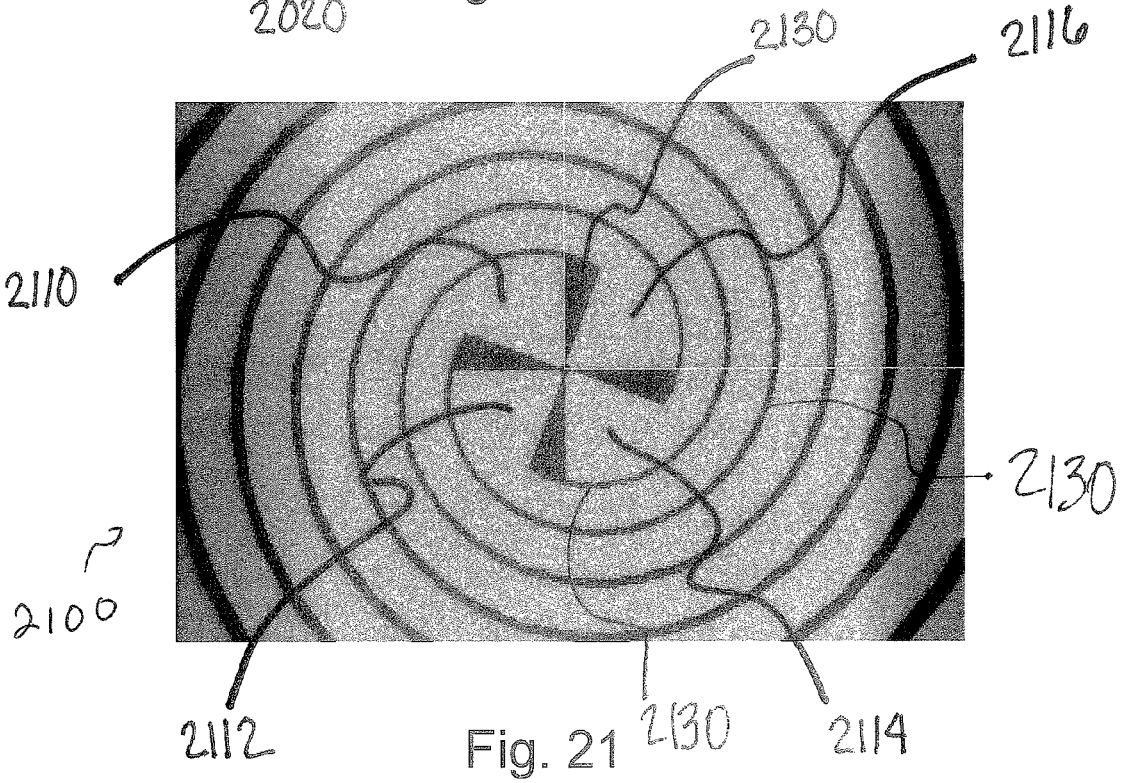
FIG. 21 is another top plan view of an antenna according to an exemplary embodiment of the present invention.

FIGS. 20 and 21 describe aspects of an exemplary embodiment of the present invention including the ability to provide an impedance match (or an improved impedance match) between an input signal and the antenna itself. As shown in FIG. 20 antenna arms 2010, 2012, 2014, 2016, 2018, 2020, 2022 and 2024 spiral outwardly from the center of the antenna device 2000 in a radially increasing manner. Between each antenna arm is a gap 2030. Each gap 2030 has a particular width 2007 between adjoining antenna arms. Notably each of the antenna radial arms 2010, 2012, 2014, 2016, 2018, 2020, 2022, and 2024 is of approximately identical width 2008 in relation to each other. The ability to reduce the width of the particular width 2007 in relation to an individual width 2008 of the antenna spiral arms 2010, 2012, 2014, 2016, 2018, 2020, 2022, and 2024 allows the antenna device 2000 to provide a specific impedance match or an approximate impedance match in mind. For instance, in the antenna shown in FIG. 20, an impedance match is provided by virtue of the gaps 2007 being of lesser width than the width 2008 of individual antenna arms such that the impedance match approaches and/or matches approximately 50 ohms. It should be noted that while the size of gap 2007 shown in FIG. 20 is small near the center of the antenna 2000, the gap eventually increases as the spiral continues outward. For instance, as shown in the center portion of FIG. 2, the gap is non-complimentary, but the gap transitions to approximately complimentary and then to complimentary as the gap travels from the center to the outer portions of area I (shown in FIGS. 2 and 3) of the coiled spiral antenna 200. It is to be understood that the location of the non-complimentary, transitional area of approaching complimentary, and then complimentary areas may be varied based on desire or need.

In FIG. 21 the spiral antenna 2100 includes antenna arms 2110, 2112, 2114 and 2116, gap areas 2130. Notably near the center of the antenna the gap area 2130 is of lesser width than the width of individual ones of antenna arms 2110, 2112, 2114, and 2116. As discussed in relation to FIG. 20, the widths reflects an aspect of the present invention whereby an impedance match (or an improved impedance match) can be configured for the signal provided as an input to the antenna 2100.

Figure 22:
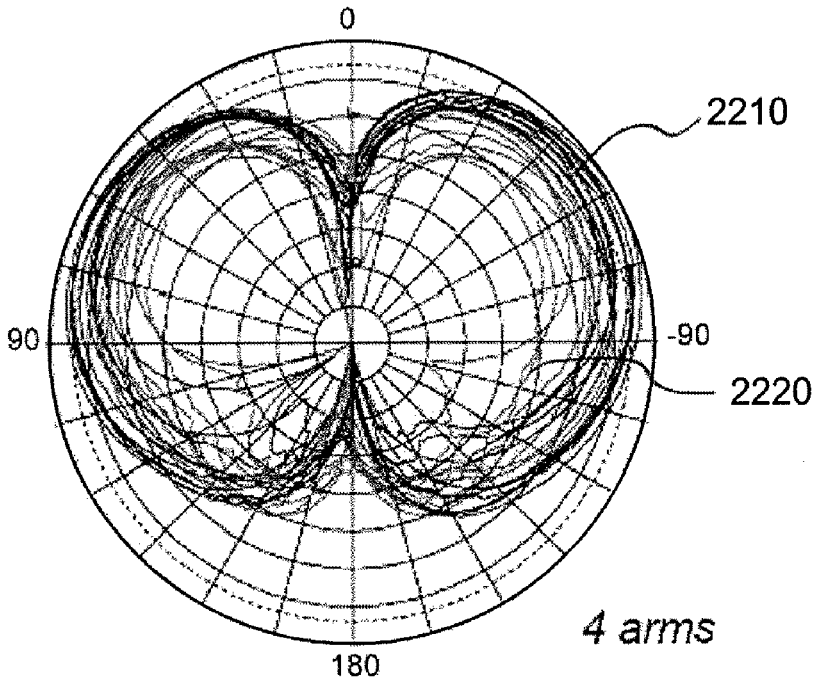
FIG. 22 is a graphical representation of a radiation pattern propagated by an exemplary embodiment of the instant invention including propagation with four antenna arms in delta mode.

FIG. 22 is a graph of a radiation pattern propagated at 600 megahertz by a coiled spiral antenna including four coiled antenna arms in delta mode (or what is otherwise known as mode 2) according to an aspect of an exemplary embodiment of the present invention. In FIG. 22 the co-polarization 2210 is slightly higher than the cross-polarization 2220. Delta mode is useful for monopulse direction finding, among other things, as would be known to one of skill in the art. Mode 2 patterns with lower cross-polarization are produced when the antenna has more than four arms.

Figure 23:
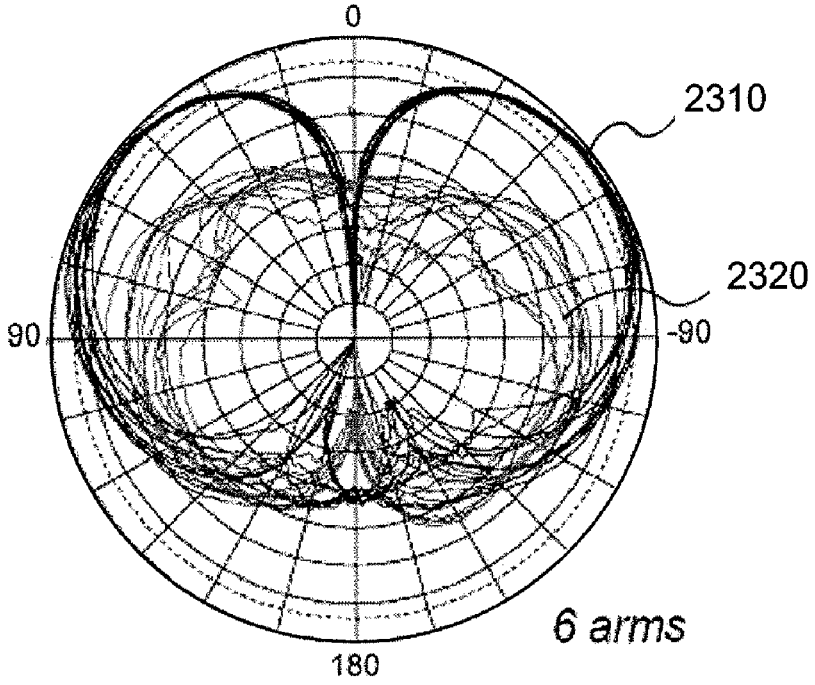
FIG. 23 is a graphical representation of a radiation pattern of an exemplary embodiment of the present invention including propagation with six antenna arms in delta mode.

FIG. 23 is a graphical representation of a radiation pattern propagated by a coiled spiral antenna including six antenna arms and operating at 600 megahertz in delta mode (or mode 2) according to an aspect of an exemplary embodiment of the present invention. The co-polarization 2310 is significantly higher than the cross-polarization 2320. As shown by the differences between FIGS. 22 and 23, the cross-polarization is reduced with the additional two arms.

Figure 24:
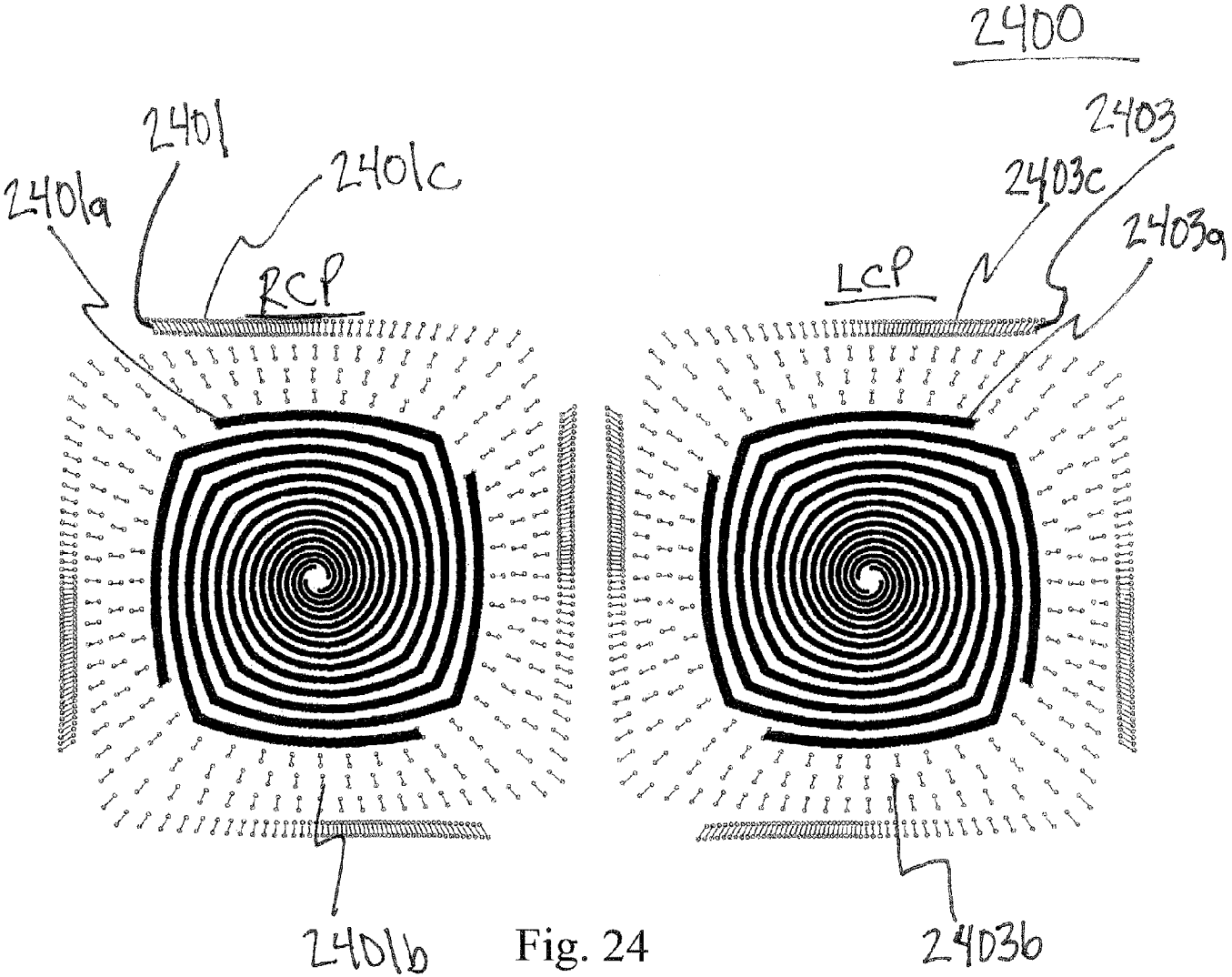
FIG. 24 is a top plan view of a dual-polarized four-arm coiled antenna according to an exemplary embodiments of the present invention.

FIG. 24 illustrates an exemplary embodiment of the present invention comprising a dual polarized antenna 2400 with both right-hand circular polarization (RCP) and left-hand circular polarization (LCP) units, wherein both the RCP and LCP units each have four antenna arms with coiled portions. For ease of understanding and for clarity, the following describes one antenna arm for each of the RCP and LCP units, but it is to be understood that each of the RCP and LCP units possess four antenna arms, and that each arm comprises a flat portion, a loosely coiled portion, and a tightly coiled portion. A shown in FIG. 24, antenna arms 2401 and 2403 respectively comprise non-coiled portions 2401*a* and 2403*a*, loosely coiled portions 2401*b* and 2403*b*, and tightly coiled portions 2401*c* and 2403*c*. The flat portions 2401*a* and 2403*a* begin in a circular fashion but eventually change shape such that they produces a square or an approximate square shape before becoming loosely coiled portions 2401*b* and 2403*b*, respectively. One purpose for this is to better conform to a square shape at the perimeter. One of skill in the art would understand that the shape of the perimeter could be configured practically in any fashion based on need or desire. Since many of the previously described exemplary embodiments of the present invention including single polarization spiral antennas provide satisfactory co- and cross-polarization results using inductive loading, the example of the dual antennas shown in FIG. 24 is one way to achieve dual polarization. Using a square geometry may make packaging easier, and may increase loading by $4/\pi$ (ratio of square perimeter to circle).

Figure 25:
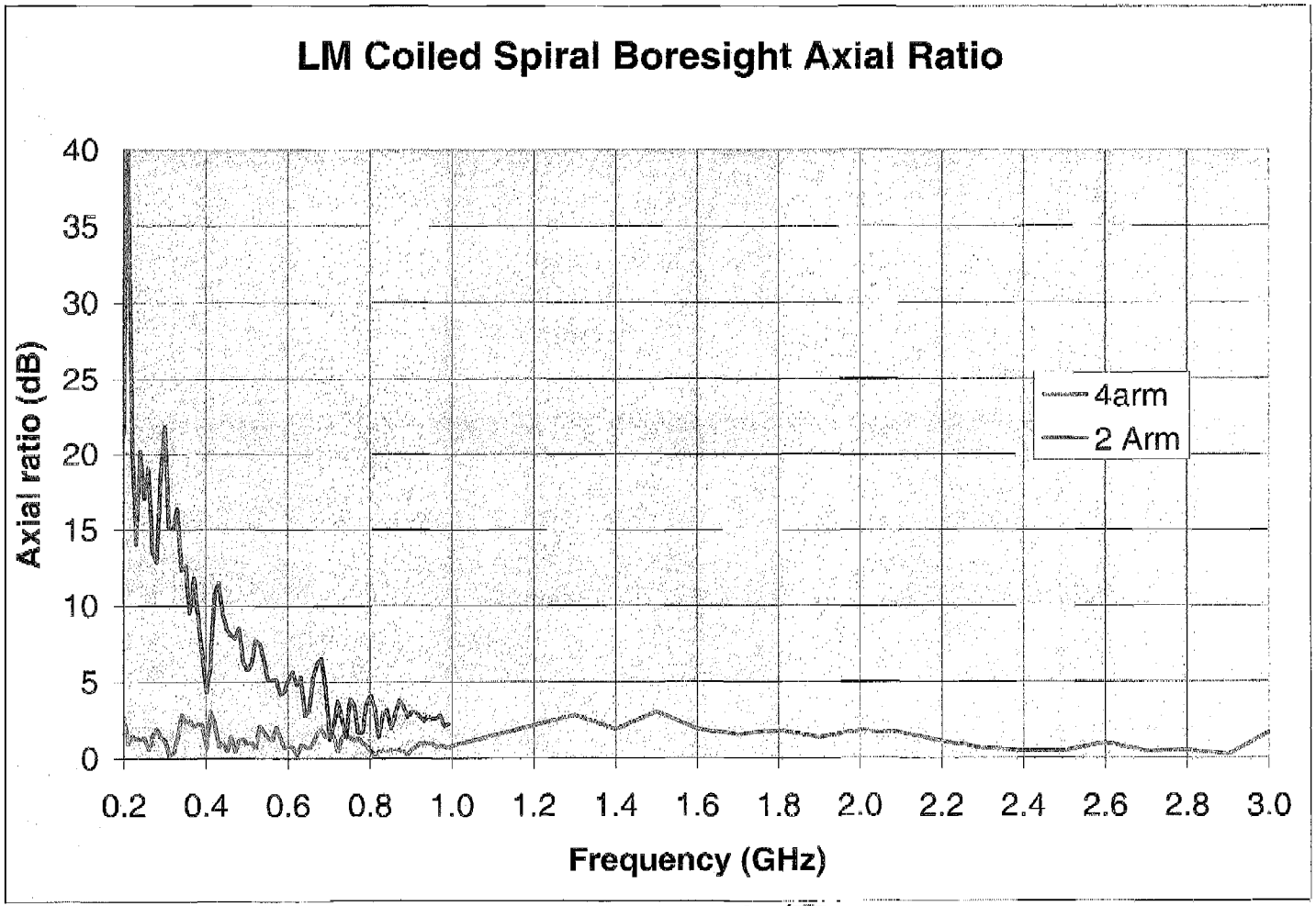
FIG. 25 is a graph showing a measured axial ratio compared to frequency according to various exemplary embodiments of the present invention.

FIG. 25 is an exemplary graph that illustrates axial ratios measured from various exemplary embodiments of the present invention, including a 2-arm spiral antenna and a 4-arm spiral antenna, both operating in the first mode. As shown in the graph, the measured axial ratios remain well below 5 dB (and mostly below 3 dB) across most of the frequency spectrum. Only the 2-arm spiral antenna produces an axial ratio that is greater than 5 dB in a certain frequency range. For example, the axial ratio of the 2-arm spiral antenna oscillates above and below the 5 dB level between 500 and 700 MHz. Below 500 MHz the measured axial ratio of the 2-arm spiral antenna is typically above 5 dB, showing increased cross-polarization in relation to co-polarization.

Exemplary versions of the present invention with greater than two spiral antenna arms are shown to have a measured axial ratio of much less than 5 dB, and thus provide an improvement over other antennas, such as the exemplary non-coiled antenna shown in FIG. 4.

Figure 26:
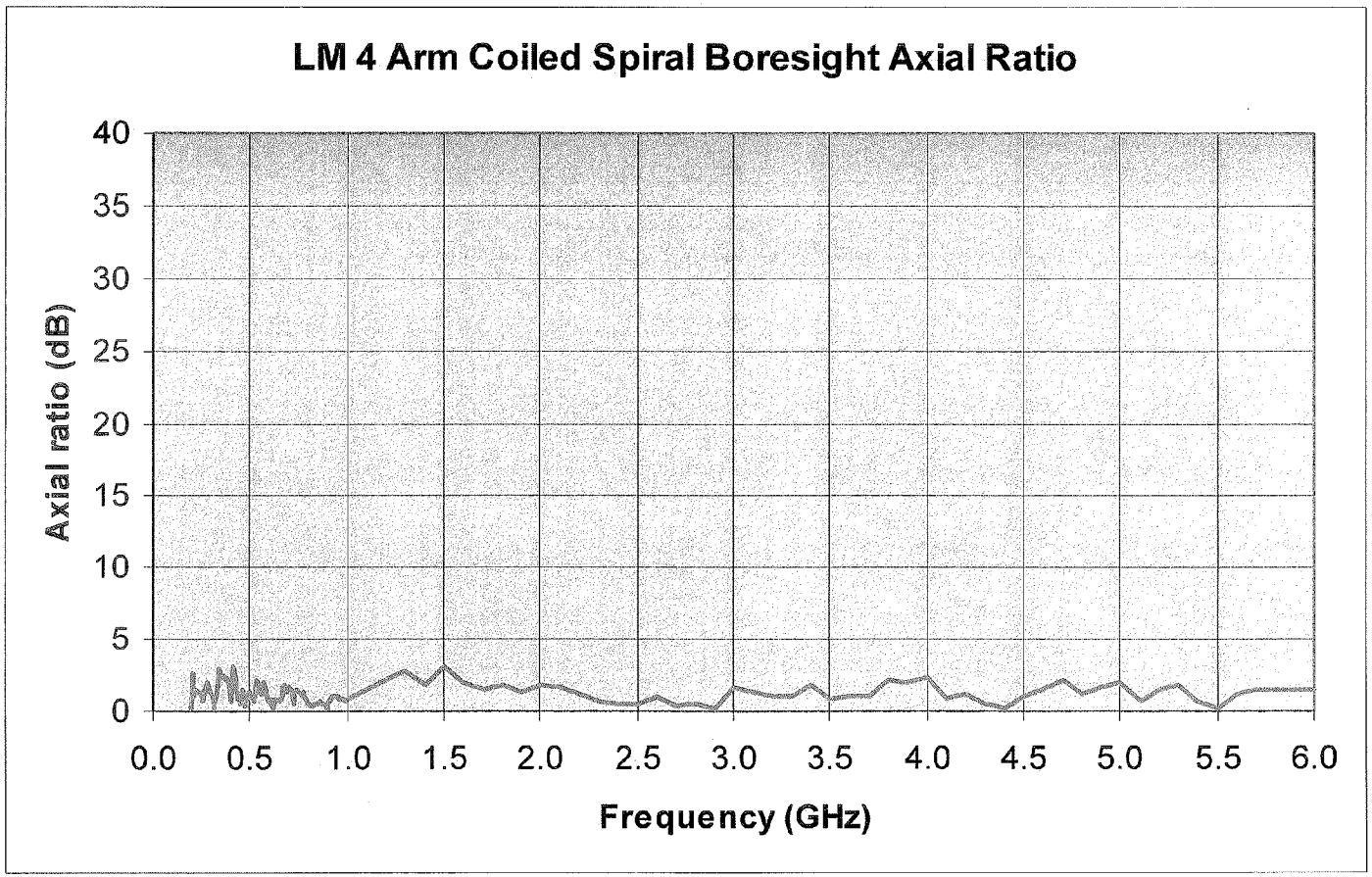
FIG. 26 is a graph showing an axial ratio measured from an exemplary embodiment of the present invention.

FIG. 26 illustrates axial ratio measurements obtained from an exemplary embodiment of the present invention including a 4-arm coiled spiral antenna. As shown in the graph, the measured axial ratio remains well below 5 dB across the frequency range between about 0.2 and 6 GHz. FIG. 26 illustrates excellent transmissibility of exemplary embodiments of the present invention including 4 coiled spiral antenna arms. Exemplary embodiments of the present invention including 3 antenna arms may achieve results similar to those shown in FIG. 26. Superior transmissibility results for various exemplary embodiments of the present invention were found with antennas having greater than two arms while operating in a first mode (for example, mode 1, sum, or $\Sigma$) that is useful for transmission/reception, for example, during angle of arrival applications. Superior transmissibility results for various exemplary embodiments of the present invention were also found with antennas having greater than four arms while operating in a second mode (a second mode is also referred to as mode 2, difference, or delta mode). A second mode is useful, for instance, for monopulse direction finding.

Figure 27B:
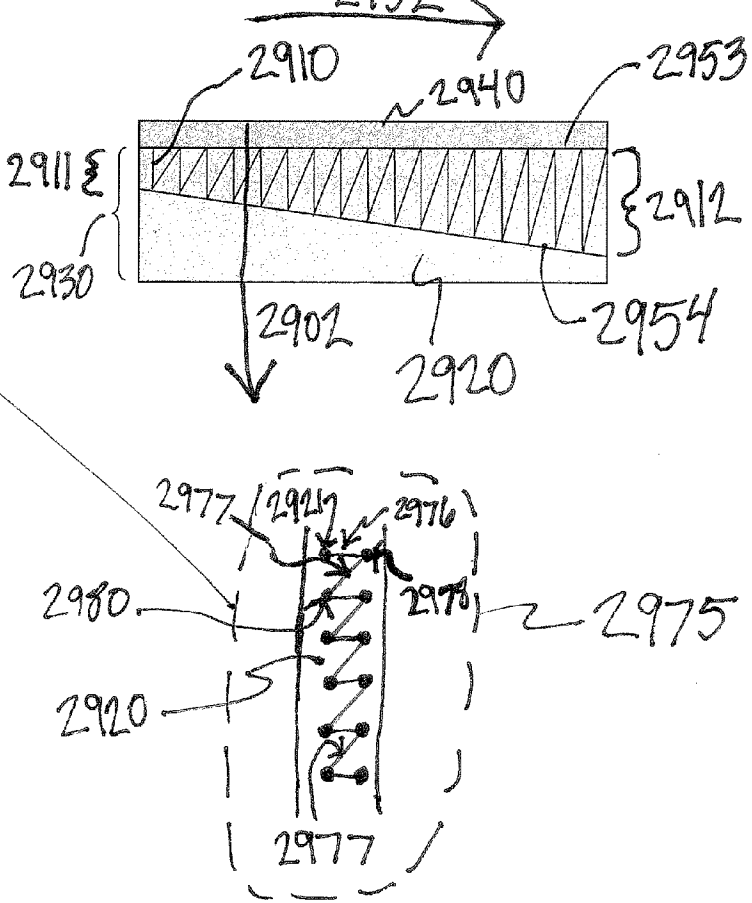
FIG. 27B illustrates a sectional view of an antenna according to an exemplary embodiment of the present invention.
Figure 27A:
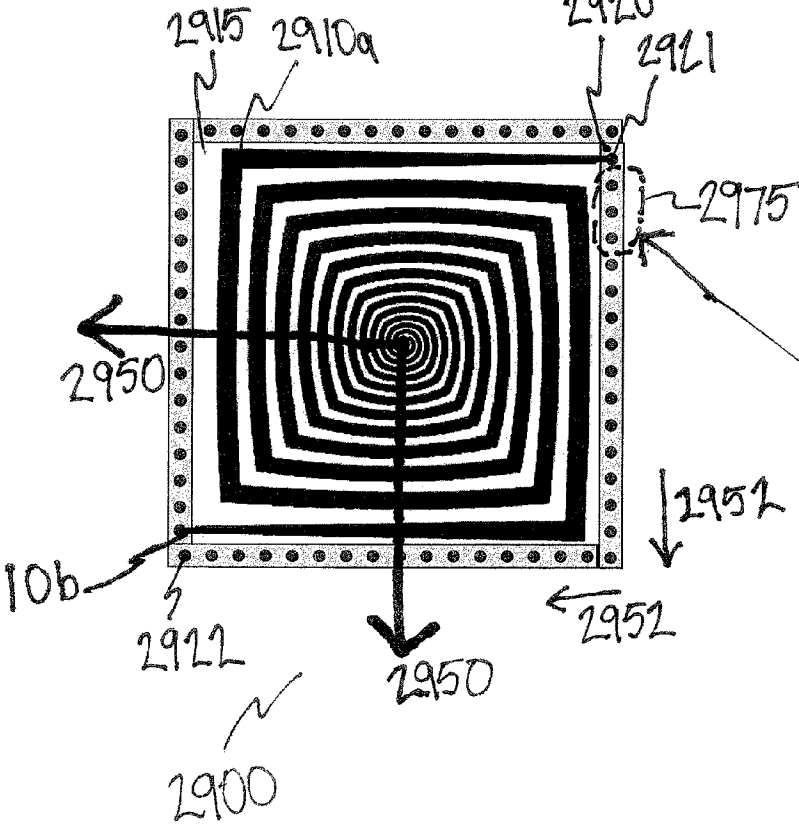
FIG. 27A illustrates a top plan view of an antenna according to an exemplary embodiment of the present invention.

FIGS. 27A (top plan view) and 27B (sectional view) illustrate a planar antenna device in accordance with an exemplary embodiment of the present invention. As illustrated, a two-armed antenna device 2900 has two antenna arms 2910*a* and 2910*b*, which begin in the center of the antenna device 2900 and extend outwardly in a fairly circular fashion but become rather square-shaped at the outer edges of the antenna device 2900. The antenna arms 2910*a* and 2910*b* conform to an outer wall 2920. A separate exemplary illustration of an outer wall is shown as an element 140 in FIGS. 1A and 1B. While FIG. 27A shows a square shape, an antenna of the present invention may have a circular shape or other shapes.

As shown in FIGS. 27A and 27B, in various exemplary embodiments of the present invention the antenna arms 2910*a*/2910*b* may continue at least to the wall 2920 and travel in the square-shaped wall 2920, which may have a depth 2930 (see FIG. 27B). Wall 2920 may be capped with a planar cap element 2940 (which is shown as antenna cap 940 in FIG. 9). In this example, each of the antenna arms 2910*a*/2910*b* travels in a first direction 2950 outwardly toward the edge of outer dielectric portion 2915 (e.g., a point where the outer dielectric portion 2915 meets with wall 2920). Each of the antenna arms 2910*a*/2910*b* then enters the wall 2920 and proceeds in a second direction 2952 while coiling in the wall 2920.

In comparing first direction 2950 to second direction 2952, first direction 2950 represents a radially outwardly spiraling direction from the center of the planar antenna device 2900 on a plane created by antenna arms 2910*a*/2910*b*. Second direction 2952 is generally perpendicular to first direction 2950. Second direction 2952 may be a direction along one or more sides of a square, as illustrated in FIG. 27A. In one aspect, second direction 2952 does not travel toward, or away from, the plane created by antenna arms 2910*a*/2910*b* but rather travels along the side of the plane created by antenna arms 2910*a*/2910*b*.

Antenna arm 2910*a* travels in first direction 2950 on the plane created by antenna arms 2910*a*/2910*b* from the center of the planar antenna device 2900 to an edge of outer dielectric portion 2915 then travels in wall 2920 in second direction 2952. Second direction 2952 for antenna arm 2910*a* may begin, for example, at first point 2921 and end at second point 2922. While traveling generally in second direction 2952, antenna arm 2910*a* may coil between a first surface 2953 and a second surface 2954 of the wall 2920. The coil direction may include a forward direction 2902 (perpendicular to second direction 2952) and a reverse direction (at an angle to forward direction 2902). As the coiled antenna arm 2910*a* travels generally in second direction 2952, it may have a height 2911 at an initial point and a height 2912 at a later point. Height 2912 may be greater, equal to, or less than height 2911. The height of the coiled antenna arm 2910*a* may progressively increase from one point to another along second direction 2952. First surface 2953 may be parallel to the plane defined by antenna arms 2910*a*/2910*b*. Second surface 2954 may be at an angle to first surface 2953. Antenna arm 2910*b* may travel in a manner similar to antenna arm 2910*a*. In this example, second surface 2954 is not parallel to first surface 2953.

The area 2975 illustrates an expanded view of an exemplary embodiment where the antenna arm 2910*a* travels into the wall 2920 at point 2921 and then coils within wall 2920. As illustrated in the expanded view of area 2975, antenna arm 2910*a* reaches point 2921, where it travels downward into wall 2920 and then travels in a width-wise direction of wall 2920 to reach point 2978. At point 2978 the antenna arm then travels upwards towards a top portion of wall 2920, where it then travels in a substantially lengthwise-direction of wall 2920 to reach point 2980. As shown in relation to FIG. 27B, the antenna arm 2910 may travel within the wall 2920 until reaching an end-point, for instance, point 2922 (shown in FIG. 27A). Within the wall 2920, the antenna arm 2910 may be either of tightly or loosely coiled, as described in previous exemplary embodiments. Further, the antenna arm 2910 may be of any height to include a consistent or varying height as generally illustrated by callouts 2911 and 2912.

Wall 2920 may be a square shape as shown by FIG. 27A, or it may be a circular shape or another shape (for example, as shown in FIG. 1, 9, or 10). When antenna arm 2910*a* leaves a first plane created by antenna arms 2910*a*/2910*b*, it may enter a second plane created by wall 2920. The second plane may be perpendicular to the first plane, and the top surface of the second plane may be co-planar with the top surface of the first plane. The second plane may include two sides of a cube or may have generally a tubular or cylindrical shape.

Each of the antenna arms 2910*a*/2910*b* may include coiled conductor portions, non-coiled conductor portions (as described with reference to FIGS. 2, 7 and 8), a combination of both, other shapes, and/or other combinations. Each of the antenna arms 2910*a*/2910*b* may also spiral in a helical fashion within wall 2920. Wall 2920 may be plastic and in some cases may be Rexolite (a commercially available plastic molding material made by C-LEC Plastics, Inc.).

Additional aspects of exemplary embodiments of the present invention may include the following: Certain exemplary embodiments may include the addition of loads at the end of the spiral arms to further attenuate cross polarized response (such as end loading with resistors for better polarization at the expense of reduced gain). Certain exemplary embodiments comprise adding coils to the arms to achieve inductive loading, thus enabling quality lower frequency patterns and making the antenna appear electrically larger than its physical size.

It is understood that any specific order or hierarchy or steps in the processes disclosed herein are merely exemplary illustrations and approaches. Based upon design preferences, it is understood that any specific order or hierarchy of steps in the process may be re-arranged. Some of the steps may be performed simultaneously.

The previous description is provided to enable persons of ordinary skill in the art to practice the various aspects and embodiments described herein. Various modifications to these aspects and embodiments will be readily apparent to those skilled in the art, and the general principles defined herein may be applied to other aspects and embodiments. A reference to an element in the singular is not intended to mean "one and only one" unless specifically stated, but rather "one or more." The term "some" refers to one or more. Underlined and/or italicized headings and subheadings are used for convenience only, do not limit the invention, and are not referred to in connection with the interpretation of the description of the invention. All structural and functional equivalents to the elements of the various embodiments of the invention described throughout this disclosure that are known or later come to be known to those of ordinary skill in the art are expressly incorporated herein by reference and intended to be encompassed by the invention. Moreover, nothing disclosed herein is intended to be dedicated to the public regardless of whether such disclosure is explicitly recited in the above description.

What is claimed is:

1. A planar antenna device comprising:

more than two conductive spiral arms, each comprising a coiled portion;

a plurality of spiral gaps;

a center dielectric portion; and an outlying dielectric portion, wherein each of the more than two conductive spiral arms is configured to receive a phase shifted input signal at a beginning point of the corresponding one of the more than two conductive spiral arms in the center dielectric portion, each of the more than two conductive spiral arms spirals from the beginning point of the corresponding one of the more than two conductive spiral arms in the center dielectric portion to an end point in the outlying dielectric portion in a radially increasing manner, and each of the plurality of spiral gaps spirals from a beginning point of the corresponding one of the plurality of spiral gaps toward an outer edge of the outlying dielectric portion in a radial manner.

2. The planar antenna device of claim 1, wherein a diameter of the planar antenna device is less than twenty inches.

3. The planar antenna device of claim 1, wherein the planar antenna device is configured to produce a measured axial ratio that is less than 5 dB over at least a frequency range of 50 MHz to more than 6 GHz.

4. The planar antenna device of claim 1, wherein the phase shifted input signal comprises a sinusoidal waveform that is divided into phase increments that are substantially equal to each other, and a total number of the more than two conductive spiral arms is equal to a total number of phase increments.

5. The planar antenna device of claim 1, wherein each of the more than two conductive spiral arms further comprises a flat portion so that the flat portion of each of the more than two conductive spiral arms is disposed only on one surface, and the flat portion is not coiled, the coiled portion of each of the more than two conductive spiral arms comprises top segments disposed on a top surface, bottom segments disposed on a bottom surface, and vertical segments disposed between the top surface and the bottom surface, and each of the vertical segments connects its corresponding one of the top segments to its corresponding one of the bottom segments to form a coil, and a distance between the top segments of the coiled portion of each of the more than two conductive spiral arms progressively decreases as each of the more than two conductive spiral arms spirals toward the end point.

6. The planar antenna device of claim 1, wherein the center dielectric portion comprises a first planar thickness, the outlying dielectric portion comprises a second planar thickness, and the first planar thickness is less than the second planar thickness.

7. A planar antenna device comprising:

a plurality of conductive spiral arms, each comprising a coiled portion;

a plurality of spiral gaps;

a center dielectric portion; and an outlying dielectric portion, wherein the center dielectric portion comprises a first planar thickness, the outlying dielectric portion comprises a second planar thickness, and the first planar thickness is less than the second planar thickness, each of the plurality of conductive spiral arms is configured to receive a phase shifted input signal at a beginning point of the corresponding one of the plurality of conductive spiral arms in the center dielectric portion, each of the plurality of conductive spiral arms spirals from the beginning point of the corresponding one of the plurality of conductive spiral arms in the center dielectric portion to an end point in the outlying dielectric portion in a radial manner, and each of the plurality of spiral gaps spirals from a beginning point of the corresponding one of the plurality of spiral gaps toward an outer edge of the outlying dielectric portion in a radial manner.

8. The planar antenna device of claim 7 wherein a diameter of the planar antenna device is less than twenty inches.

9. The planar antenna device of claim 7, wherein the planar antenna device is configured to produce a measured axial ratio that is less than 5 dB over at least a frequency range of 50 MHz to more than 6 GHz.

10. The planar antenna device of claim 7, wherein the phase shifted input signal comprises a sinusoidal waveform that is divided into phase increments that are substantially equal to each other, and a total number of the plurality of conductive spiral arms is equal to the total number of phase increments.

11. The planar antenna device of claim 7, wherein each of the more than two conductive spiral arms further comprises a flat portion so that the flat portion of each of the more than two conductive spiral arms is disposed only on one surface, and the flat portion is not coiled, the coiled portion of each of the more than two conductive spiral arms comprises top segments disposed on a top surface, bottom segments disposed on a bottom surface, and vertical segments disposed between the top surface and the bottom surface, and each of the vertical segments connects its corresponding one of the top segments to its corresponding one of the bottom segments to form a coil, and a distance between the top segments of the coiled portion of each of the more than two conductive spiral arms progressively decreases as each of the more than two conductive spiral arms spirals toward the end point.

12. The planar antenna device of claim 7, further comprising:

a wall configured to structurally support an edge of the outlying dielectric portion, the wall being substantially square-shaped, wherein each of the plurality of conductive spiral arms spirals at least in a first direction from the beginning point of the corresponding one of the plurality of conductive spiral arms, and after spiraling to the outer edge of the outlying dielectric portion, each of the plurality of conductive spiral arms travels in the wall at least in a second direction in a coiled manner from a first point to a second point forming a coil arm between the first point and the second point, and the second direction is different from the first direction.

13. A planar antenna device comprising:

a plurality of conductive spiral arms;

a plurality of spiral gaps;

a center dielectric portion; and an outlying dielectric portion; and a wall, wherein each of the plurality of conductive spiral arms is configured to receive a phase shifted input signal at a beginning point of the corresponding one of the plurality of conductive spiral arms in the center dielectric portion, each of the plurality of spiral gaps spirals from a beginning point of the corresponding one of the plurality of spiral gaps toward an edge of the outlying dielectric portion in a radial manner, each of the plurality of conductive spiral arms spirals at least in a first direction from the beginning point of the corresponding one of the plurality of conductive spiral arms in the center dielectric portion toward the outlying dielectric portion in a radially increasing manner, after spiraling to the outlying dielectric portion, each of the plurality of conductive spiral arms travels in the wall at least in a second direction in a coiled manner from a first point to a second point forming a coil arm between its first point and its second point, and the second direction is different from the first direction.

14. The planar antenna device of claim 13, wherein a diameter of the planar antenna device is less than twenty inches.

15. The planar antenna device of claim 13, wherein the wall is substantially square-shaped.

16. The planar antenna device of claim 13, wherein the coil arm of each of the plurality of conductive spiral arms zig-zags between a first surface and a second surface of the wall, and the height of the coil arm of each of the plurality of conductive spiral arms progressively increases from its first point to its second point.

17. The planar antenna device of claim 13, wherein the first direction is a radially outward direction, and the second direction is perpendicular to the first direction.

18. The planar antenna device of claim 13, wherein when each of the plurality of conductive spiral arms spirals in the first direction, each of the plurality of conductive spiral arms spirals comprises a coiled portion.

19. The planar antenna device of claim 13, wherein the center dielectric portion comprises a first planar thickness, the outlying dielectric portion comprises a second planar thickness, and the first planar thickness is less than the second planar thickness.

20. The planar antenna device of claim 13, wherein for each of the plurality of conductive spiral arms, its first point is a point where a corresponding one of the plurality of conductive spiral arms starts to travel in the wall, and its second point is a point where the corresponding one of the plurality of conductive spiral arms ends its travel in the wall, and each of the plurality of conductive spiral arms travels between its first point and its second point in a manner that does not generally increase radially.

* * * * *